US007369783B2

(12) United States Patent
Kikuchi

(10) Patent No.: US 7,369,783 B2
(45) Date of Patent: May 6, 2008

(54) IMAGE FORMING APPARATUS, PROCESS CARTRIDGE, AND DEVELOPMENT UNIT

(75) Inventor: Hideo Kikuchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 140 days.

(21) Appl. No.: 10/975,621

(22) Filed: Oct. 29, 2004

(65) Prior Publication Data

US 2005/0095017 A1 May 5, 2005

(30) Foreign Application Priority Data

Oct. 31, 2003 (JP) ..... 2003-373056
Oct. 31, 2003 (JP) ..... 2003-373064

(51) Int. Cl.
*G03G 15/00* (2006.01)

(52) U.S. Cl. ..... 399/12; 399/13

(58) Field of Classification Search ..... 399/12, 399/13

See application file for complete search history.

(56) References Cited

U.S. PATENT DOCUMENTS 6,097,405 A * 8/2000 Lo et al. ..... 347/6
6,229,967 B1 * 5/2001 Miya et al. ..... 399/12
6,308,018 B1 * 10/2001 Yoshida et al. ..... 399/53
6,390,590 B1 * 5/2002 Hansburg ..... 347/19
6,600,881 B2 * 7/2003 Cornelius ..... 399/12

FOREIGN PATENT DOCUMENTS

JP 61132969 A * 6/1986
JP 11-24536 1/1999
JP 11024536 A * 1/1999
JP 2001-80090 3/2001
JP 2001-83862 3/2001
JP 2001350394 A * 12/2001

OTHER PUBLICATIONS

JP 61-292168 A , Abstract , Dec. 22, 1986, Hayashi et al.*

* cited by examiner

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

An image forming apparatus includes a plurality of developing devices, each of which stores a toner, a developing device installation section, in which the developing device is detachably installed, a color display unit that displays a toner color corresponding to the toner stored in the developing device, and a detector that detects whether the toner color in the developing device matches the toner color corresponding to the developing device installation section, after the developing device is installed in the developing device installation section.

16 Claims, 22 Drawing Sheets

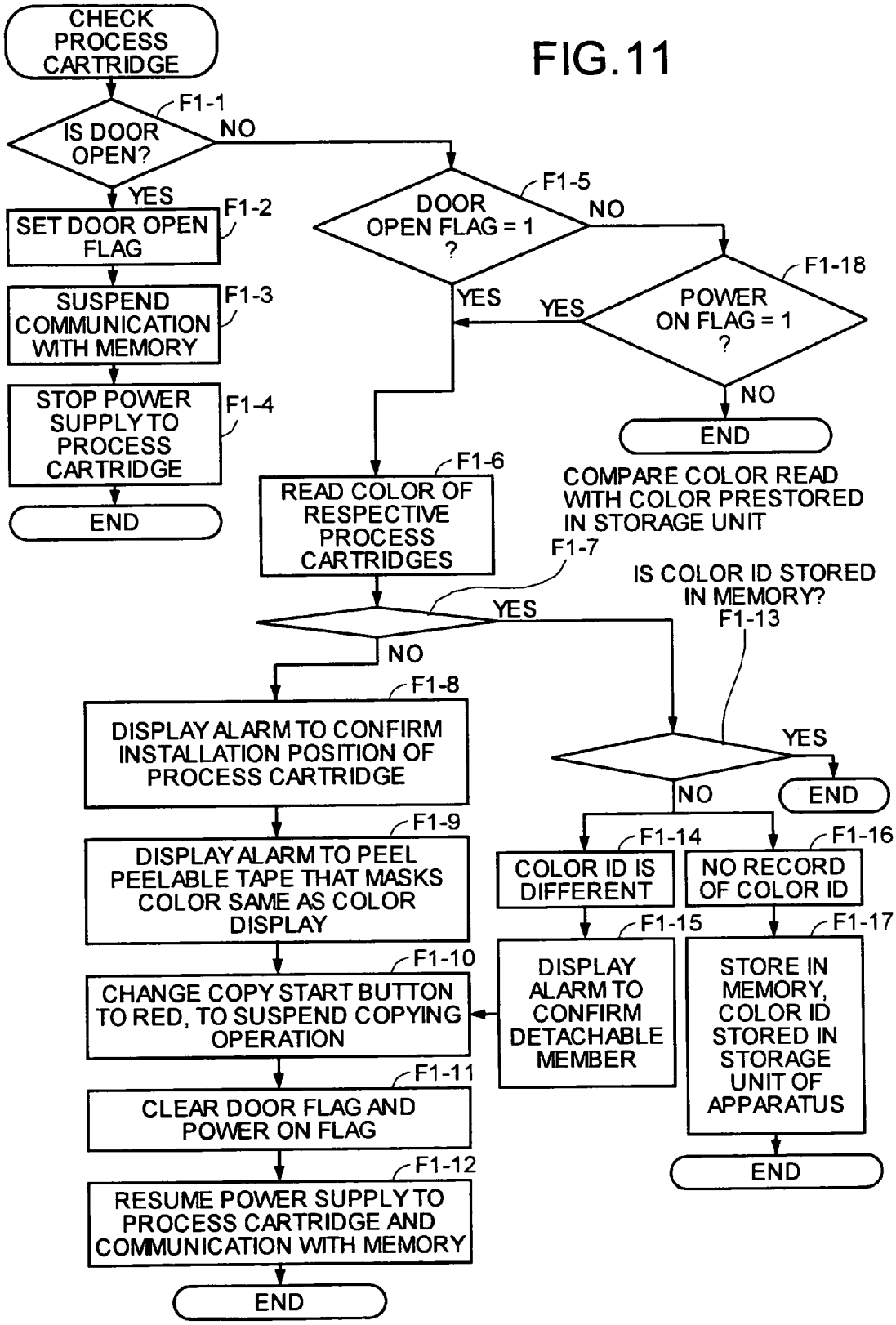
FIG.11
CHECK PROCESS CARTRIDGE
F1-1
IS DOOR OPEN?
NO
YES
F1-2
SET DOOR OPEN FLAG
F1-3
SUSPEND COMMUNICATION WITH MEMORY
F1-4
STOP POWER SUPPLY TO PROCESS CARTRIDGE
END
F1-5
DOOR OPEN FLAG = 1 ?
NO
YES
F1-18
POWER ON FLAG = 1 ?
YES
NO
END
F1-6
READ COLOR OF RESPECTIVE PROCESS CARTRIDGES
COMPARE COLOR READ WITH COLOR PRESTORED IN STORAGE UNIT
F1-7
IS COLOR ID STORED IN MEMORY?
F1-13
YES
NO
F1-8
DISPLAY ALARM TO CONFIRM INSTALLATION POSITION OF PROCESS CARTRIDGE
F1-9
DISPLAY ALARM TO PEEL PEELABLE TAPE THAT MASKS COLOR SAME AS COLOR DISPLAY
F1-10
CHANGE COPY START BUTTON TO RED, TO SUSPEND COPYING OPERATION
F1-11
CLEAR DOOR FLAG AND POWER ON FLAG
F1-12
RESUME POWER SUPPLY TO PROCESS CARTRIDGE AND COMMUNICATION WITH MEMORY
END
YES
NO
END
F1-14
COLOR ID IS DIFFERENT
F1-16
NO RECORD OF COLOR ID
F1-15
DISPLAY ALARM TO CONFIRM DETACHABLE MEMBER
F1-17
STORE IN MEMORY, COLOR ID STORED IN STORAGE UNIT OF APPARATUS
END

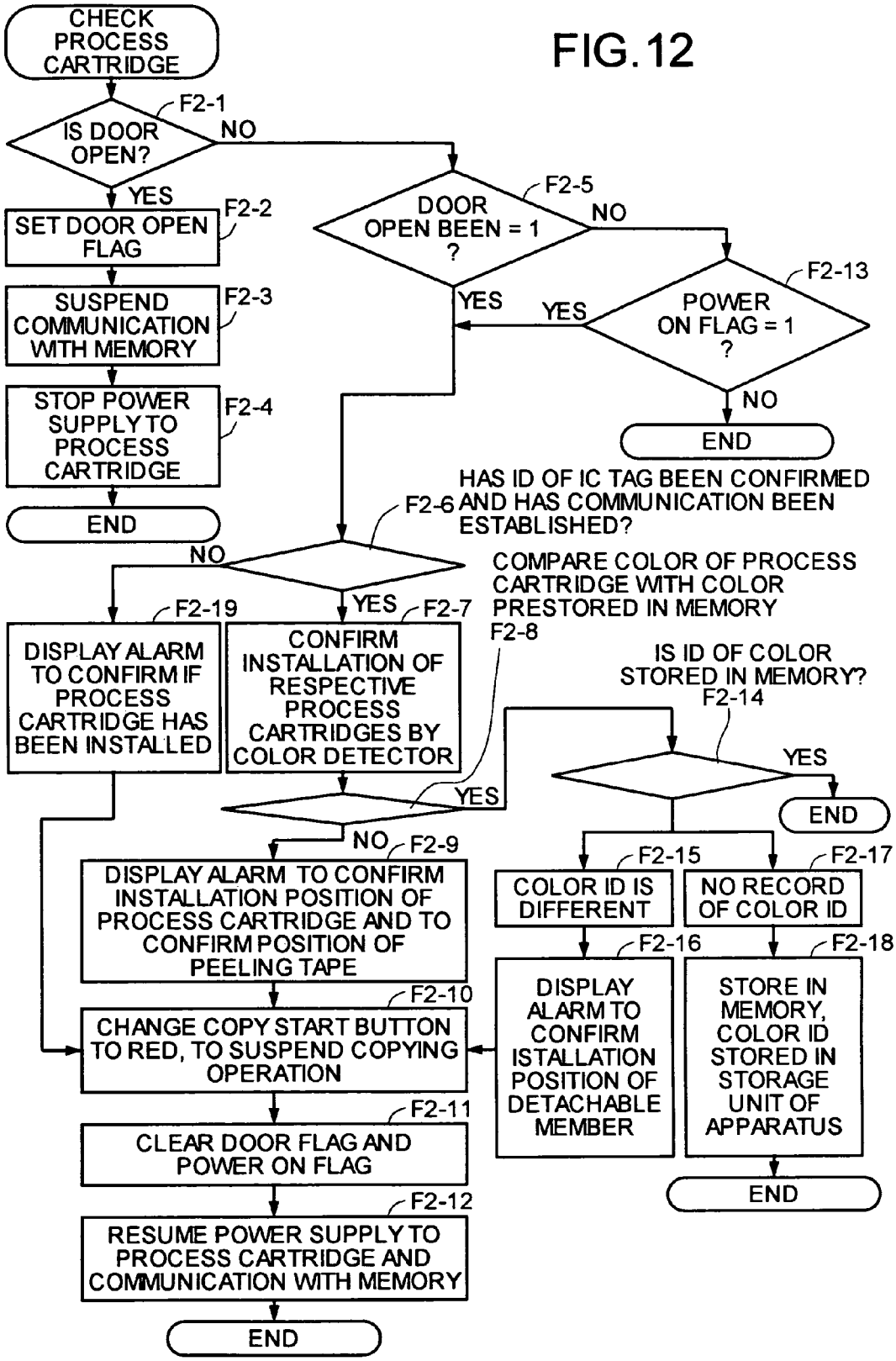
FIG. 12
CHECK PROCESS CARTRIDGE
F2-1
IS DOOR OPEN?
NO
YES
F2-2
SET DOOR OPEN FLAG
F2-3
SUSPEND COMMUNICATION WITH MEMORY
F2-4
STOP POWER SUPPLY TO PROCESS CARTRIDGE
END
F2-5
DOOR OPEN BEEN = 1 ?
NO
YES
F2-13
POWER ON FLAG = 1 ?
YES
NO
END
F2-6
HAS ID OF IC TAG BEEN CONFIRMED AND HAS COMMUNICATION BEEN ESTABLISHED?
NO
YES
F2-19
DISPLAY ALARM TO CONFIRM IF PROCESS CARTRIDGE HAS BEEN INSTALLED
F2-7
CONFIRM INSTALLATION OF RESPECTIVE PROCESS CARTRIDGES BY COLOR DETECTOR
F2-8
COMPARE COLOR OF PROCESS CARTRIDGE WITH COLOR PRESTORED IN MEMORY
YES
NO
F2-9
DISPLAY ALARM TO CONFIRM INSTALLATION POSITION OF PROCESS CARTRIDGE AND TO CONFIRM POSITION OF PEELING TAPE
F2-10
CHANGE COPY START BUTTON TO RED, TO SUSPEND COPYING OPERATION
F2-11
CLEAR DOOR FLAG AND POWER ON FLAG
F2-12
RESUME POWER SUPPLY TO PROCESS CARTRIDGE AND COMMUNICATION WITH MEMORY
END
F2-14
IS ID OF COLOR STORED IN MEMORY?
YES
END
F2-15
COLOR ID IS DIFFERENT
F2-17
NO RECORD OF COLOR ID
F2-16
DISPLAY ALARM TO CONFIRM ISTALLATION POSITION OF DETACHABLE MEMBER
F2-18
STORE IN MEMORY, COLOR ID STORED IN STORAGE UNIT OF APPARATUS
END

IMAGE FORMING APPARATUS, PROCESS CARTRIDGE, AND DEVELOPMENT UNIT

CROSS-REFERENCE TO THE RELATED APPLICATIONS

The present document incorporates by reference the entire contents of Japanese priority documents, 2003-373064 filed in Japan on Oct. 31, 2003, and 2003-373056 filed in Japan on Oct. 31, 2003.

BACKGROUND OF THE INVENTION

1) Field of the Invention

The present invention relates to an image forming apparatus, a process cartridge, and a development unit.

2) Description of the Related Art

Conventionally, as a color image forming apparatus, there is a tandem type image forming apparatus in which latent images formed on a plurality of photoconductors are manifested in toner images by a developing device for each color, and the toner images are sequentially transferred onto an intermediate transfer belt or a transfer material to form a color image. As an example, forming a color image is realized by sequentially superimposing four color toner images of black (Bk), yellow (Y), magenta (M), and cyan (C) formed on the photoconductors onto the intermediate transfer belt or the transfer material.

Further, an apparatus is known in which a developing device and a device used for an image forming process such as a photoconductor are formed integrally to form a process cartridge, which is integrally detachable from the image forming apparatus. In the case of the tandem type color image forming apparatus, four process cartridges of yellow, magenta, cyan, and black are installed, corresponding to the toner color to be replenished. Heretofore, there has been an instance where a process cartridge was installed by mistake, in a place where a process cartridge for another color was to be installed. In this case, since the toner supplied from the image forming apparatus does not match with the color toner stored in the developing device of the process cartridge, a mismatching color toner may be mixed in the developing device. To prevent such mistake in installation, the structure of a section of the apparatus body where the process cartridge is to be installed (hereinafter, "station") is made different for each color, thereby preventing a process cartridge from being installed in a section for a mismatching color. Accordingly, the structure itself of the process cartridge should be different for each color, and parts different for each color need to be produced. Hence, it becomes necessary to provide a separate production line and a model of the process cartridge for each color, thereby increasing the production cost.

Therefore, various units have been proposed, to prevent mistakes in installation, even if a common process cartridge is used. Japanese Patent Application Laid-Open No. 2001-83862 (hereinafter, "document (1)") discloses an apparatus in which a common process cartridge is provided with a storage unit to store the color of toner replenished for the first time. When installed in the station, the process cartridge compares the toner color stored in the storage unit with the toner color recorded in the apparatus body. Thus, if the process cartridge is installed in a station for a different color, the color stored in the storage unit does not match with the color stored in the apparatus body, and the image forming operation is suspended or an alarm is displayed. Further, Japanese Patent Application Laid-Open No. H11-24536

(hereinafter, "document (2)") discloses a process cartridge common to respective colors in which a seal of a color that is same as the toner color stored in the developing device in the process cartridge is attached to a color identification display section. By this seal, users can recognize the color of the process cartridge, thereby preventing a process cartridge from being installed in a station for a mismatching color. Thus, in documents (1) and (2), a common process cartridge can be used, and it is not necessary to provide a separate production line and a model of the process cartridge for each color, thereby decreasing the production cost. Further, the user does not have to store process cartridges for each color, thereby reducing the user's management load.

However, in the case of the process cartridge in document (1), there is no identification display that can be recognized by the user. Therefore, once the process cartridge is taken out from the apparatus, the user cannot recognize which color toner is stored in the process cartridge. Therefore, the user may install the process cartridge in a station for a mismatching color. Further, in the case of the process cartridge in document (2), there is an identification display, and the user can recognize which color toner is stored in the process cartridge, but there is no detector that detects mistakes in installation. Therefore, if the user erroneously installs a process cartridge in a station for a mismatching color, and executes the image forming operation without noticing the error installation, a mismatching color toner may be mixed in the developing device of the process cartridge.

In view of the above problems, it is an object of the present invention to provide an image forming apparatus and a process cartridge, which avoid erroneous installation by users, and can detect error in installation, if any.

Further, Japanese Patent Application Laid-Open No. 2001-80090 (hereinafter, "(3)") discloses a unit in which pin holes of a number corresponding to the color types are provided in the process cartridge. By changing the position of a pin to be inserted in the pin hole, the shape of the process cartridge becomes different for each color. Accordingly, the parts can be shared, thereby reducing the production cost. Further, a guide groove is provided for guiding the pin provided in the process cartridge in the insertion direction at a position corresponding to the color. Thus, erroneous installation of the process cartridge is prevented.

However, in (3), error in installation of the process cartridge is prevented by a difference between the shape of the apparatus body and the shape of the process cartridge. Therefore, if the user pushes the process cartridge into the apparatus body without noticing that it is a process cartridge for a different color, the apparatus body may get damaged or the pin may break.

SUMMARY OF THE INVENTION

It is an object of the present invention to at least solve the problems in the conventional technology.

An image forming apparatus according to an aspect of the present invention includes a plurality of developing devices, each of which stores a toner; a developing device installation section, in which the developing device is detachably installed; a color display unit that displays a toner color corresponding to the toner stored in the developing device; and a detector that detects whether the toner color in the developing device matches the toner color corresponding to the developing device installation section, after the developing device is installed in the developing device installation section.

A process cartridge according to another aspect of the present invention includes a developing device, an image carrier, and at least one image forming process unit from among a charging unit, an exposure unit, and a cleaning unit that are integrally formed, and that are detachable from an image forming apparatus; a color display unit that displays a toner color corresponding to a toner stored in the developing device; and a plurality of color display section shielding members that cover corresponding color display sections, wherein the color display section shielding members are detachable.

A development unit according to still another aspect of the present invention includes at least one developing device that is detachable from an image forming apparatus; a color display section that displays a toner color corresponding to a toner stored in the developing device; and a plurality of color display section shielding members that cover corresponding color display sections, wherein the color display section shielding members are detachable.

An image forming apparatus according to still another aspect of the present invention includes a plurality of developing devices, each of which stores a toner; and a developing device installation section, in which the developing device is detachably installed. The developing device includes a detachable member, and a plurality of attachment sections such that the detachable member is attached to that attachment section which corresponds to the color of the toner stored in the developing device, and the developing device installation section includes a detector that detects the presence of the detachable member after the developing device is installed in the developing device installation section, the detector being provided at a position facing the attachment section that corresponds to the same color as the toner color corresponding to the developing device installation section.

A process cartridge according to still another aspect of the present invention includes a developing device, an image carrier, and at least one image forming process unit from among a charging unit, an exposure unit, and a cleaning unit that are integrally formed, and that are detachable from an image forming apparatus; a detachable member and a plurality of attachment sections such that the detachable member is attached to that attachment section which corresponds to the color of toner stored in the developing device.

A development unit according to still another aspect of the present invention includes at least one developing device that is detachable from an image forming apparatus; a detachable member; and a plurality of attachment sections such that the detachable member is attached to that attachment section which corresponds to the color of the toner stored in the developing device.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 11 is a flowchart of a process procedure for detecting the color of the process cartridge;

FIG. 12 is another flowchart of a process procedure for detecting the color of the process cartridge;

DETAILED DESCRIPTION

Figure 1:
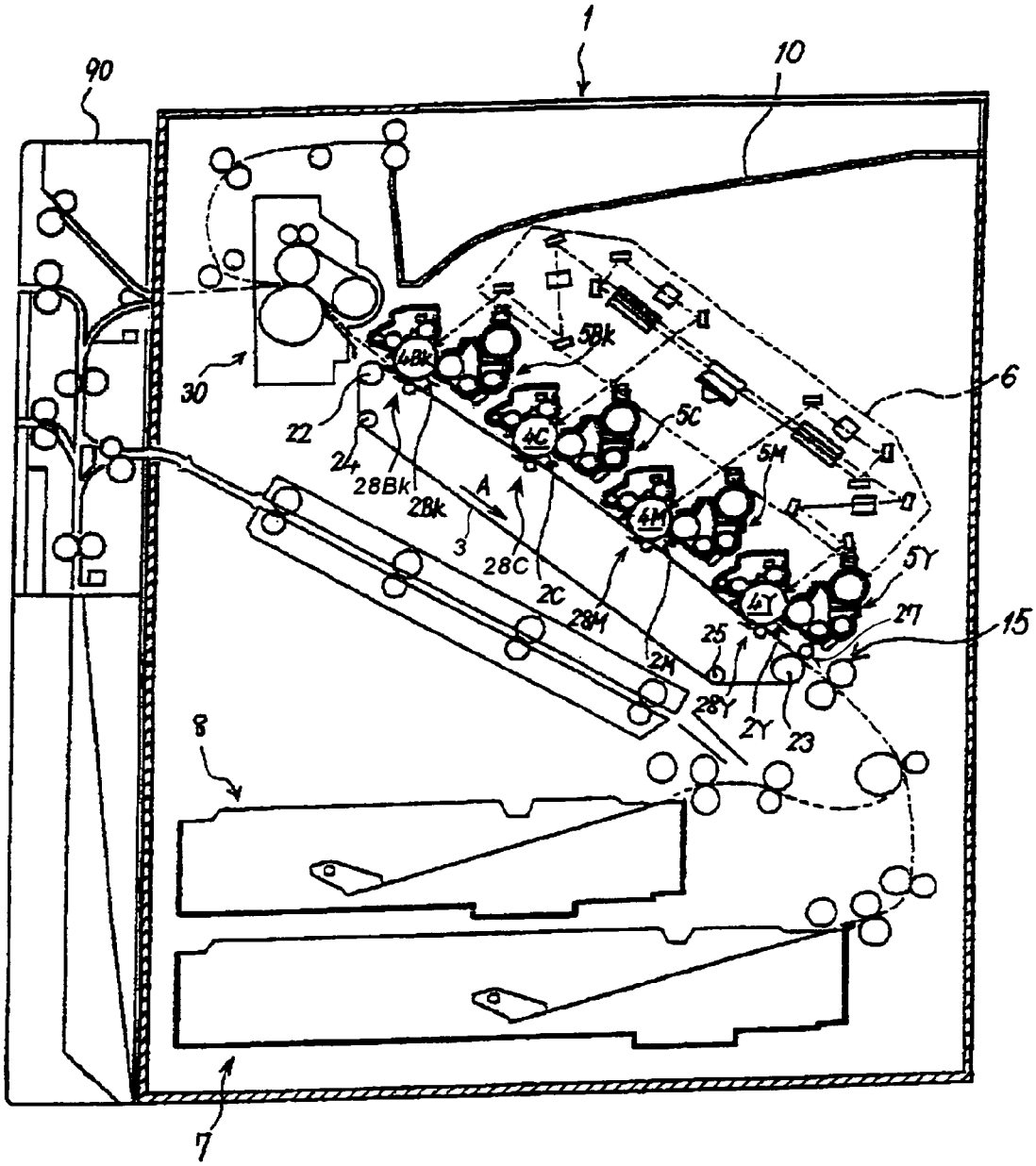
FIG. 1 is a schematic block diagram of an image forming apparatus according to an embodiment.

An exemplary embodiment of an image forming apparatus, a process cartridge, and a development unit according to the present invention will be explained below. FIG. 1 is a diagram of an electro-photographic full color printer as the image forming apparatus according to the embodiment of the present invention. Photoconductor units 2Y, 2M, 2C, and 2Bk as a plurality of image carrier units are detachably installed in a box-shape apparatus body 1. Needless to say, Y, M, C, and Bk designated to each numeral in the respective reference signs represent that these are members for yellow, magenta, cyan, and black (the same applies below). An endless transfer belt 3 as a recording material carrier is arranged at the center of the apparatus body 1, slanting in the diagonal direction of the apparatus body 1. The transfer belt 3 spans over a plurality of rollers, to one of which a rotary driving force is transmitted, and can rotate in a direction shown by arrow A.

The transfer belt 3 is provided in a transfer carrier belt device 20. The transfer belt 3 is spanned over a drive roller 22, a driven roller 23, and tension rollers 24 and 25 in a tensioned condition. Transfer brushes 28M, 28C, 28Y, and 28Bk are brought into contact with the inside of the upper traveling surface of the transfer belt 3, at a position facing drum-like photoconductors 4M, 4C, 4Y, and 4Bk respectively, in the respective photoconductor units 2M, 2C, 2Y, and 2Bk. A transfer bias of the opposite polarity (positive polarity) to the charging polarity (negative polarity in this embodiment) of the toner is applied to the transfer brushes 28M, 28C, 28Y, and 28Bk. A paper attracting roller 27 is provided above the driven roller 23, with the transfer belt 3 in between. Recording paper is fed from between the driven roller 23 and the paper attracting roller 27 onto the transfer belt 3, and carried in a state with the paper electrostatically attracted on the transfer belt 3 by the bias voltage applied to the paper attracting roller 27. In this embodiment, because the transfer carrier belt device 20 is slanting, the space occupied by the transfer carrier belt device 20 in the horizontal direction reduces.

The photoconductor units 2Y, 2M, 2C, and 2Bk have the photoconductors 4Y, 4M, 4C, and 4Bk as image carriers, and are arranged above the belt, so that the surfaces of the respective photoconductors come in contact with the transfer belt 3. A belt-like photoconductor or the like may be used for the photoconductors 4Y, 4M, 4C, and 4Bk. The photoconductor units 2Y, 2M, 2C, and 2Bk form toner images of the respective colors, that is, yellow, magenta, cyan, and black images, on the photoconductors 4Y, 4M, 4C, and 4Bk, and have identical configuration, but are arranged at different positions in the apparatus body 1. A developing device 5Y is arranged so as to face the photoconductor 4Y. The developing device 5Y develops an electrostatic latent image by supplying a two-component developer containing a yellow toner and a carrier, onto the electrostatic latent image on the photoconductor 4Y. Likewise, developing device 5M, 5C, and 5Bk are respectively arranged so as to face the photoconductors 4M, 4C, and 4Bk, and have the same configuration.

Only the photoconductor unit 2Y for yellow will be explained below. An optical writing unit 6 as an exposure unit is arranged above the photoconductor unit 2Y, and a double-sided unit is arranged below the photoconductor unit 2Y. Paper feed units 7 and 8 that can store transfer materials of different sizes are arranged below the double-sided unit. A fixing device 30 is arranged on the downstream side of the transfer belt 3.

Figure 2:
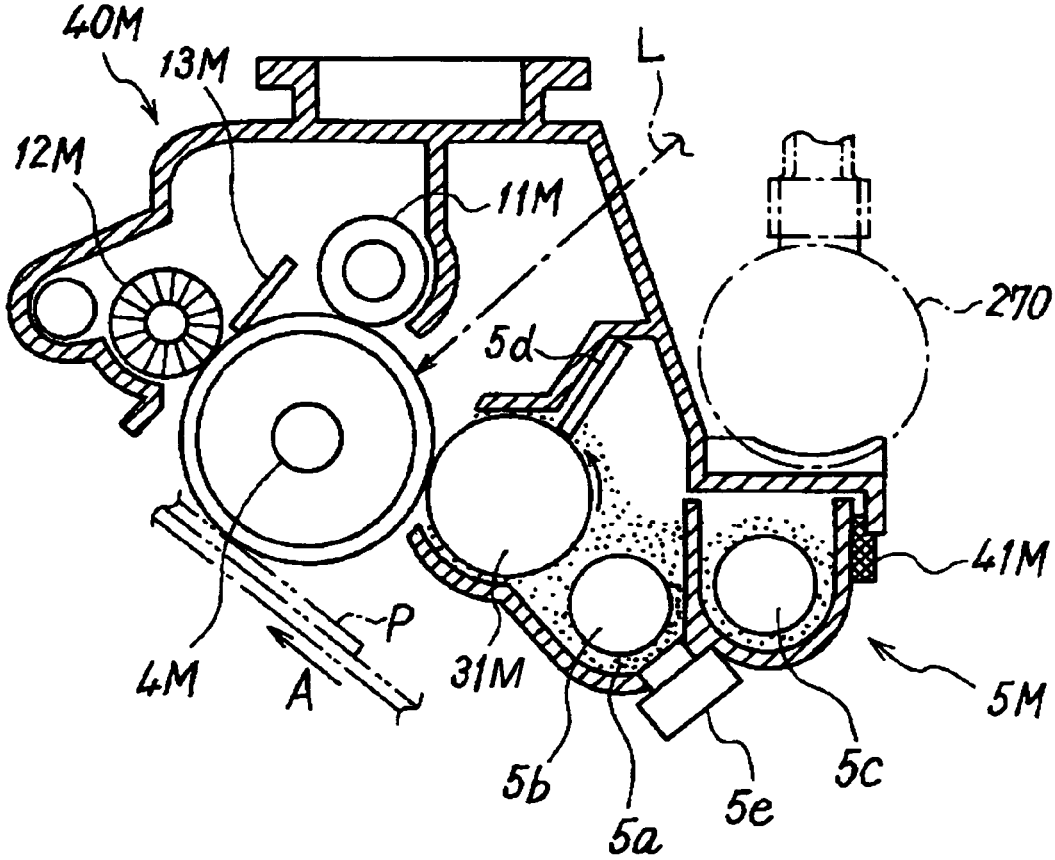
FIG. 2 is a schematic block diagram of a process cartridge that includes a developing device.

FIG. 2 is a schematic block diagram of the magenta photoconductor unit 2M, from among the photoconductor units 2Y, 2M, 2C, and 2Bk. Because the configuration of the other photoconductor units 2Y, 2C, and 2Bk is the same, the explanation thereof is omitted.

Figure 3:
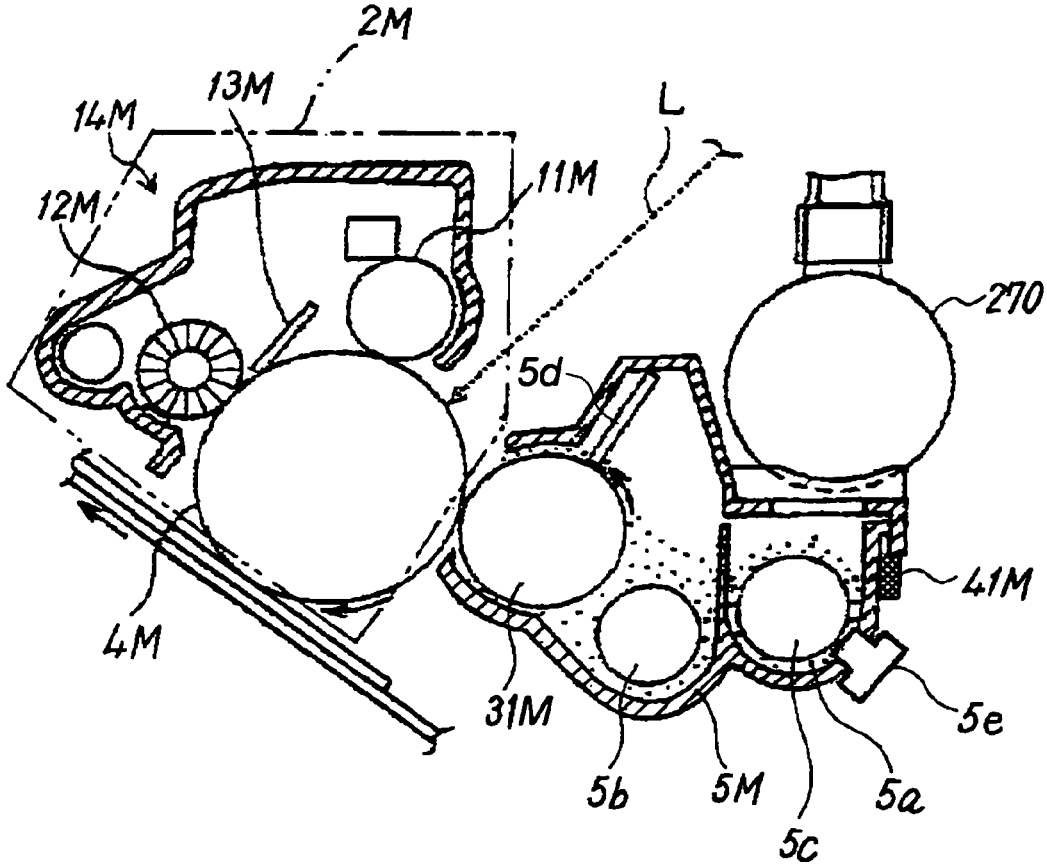
FIG. 3 is a schematic block diagram of the image forming apparatus that includes the developing device and a photoconductor unit.

In FIG. 2, the photoconductor unit 2M constitutes a process cartridge 40M detachably fitted to the apparatus body 1. In other Words, the photoconductor 4M, a charging roller 11M as a charging unit abutting against the photoconductor 4M, a cleaning device 14M that cleans the surface of the photoconductor 4M by a brush roller 12M and a cleaning blade 13M, and the developing device 5M are integrally formed. By constituting the process cartridge 40M detachably with respect to the apparatus body 1, the photoconductor 4 and the like can be replaced separately, thereby improving the maintainability. An IC tag 41M is attached to the process cartridge 40M. The IC tag 41 is mounted with a nonvolatile memory, which stores information on the color of the process cartridge, the cartridge ID, the production date, the activation date, the number of recycles, the number of copies, the current date, and the like. The process cartridge is obtained by integrally forming the photoconductor 4M, the charging roller 11M, the cleaning device 14M, and the developing device 5M, but the process cartridge is not limited thereto, and for example, as shown in FIG. 3, the process cartridge may be divided into a photoconductor unit 2M including the photoconductor 4M, the charging roller 11M, and the cleaning device 14M, and the developing device 5M, and the respective units may be detachable from the apparatus body. In this case, the IC tag 41M is attached to the developing device 5M.

In the photoconductor unit having such a configuration, at first, the surface of the photoconductor 4M is uniformly charged by the charging roller 11M. Laser beams L modulated and deflected by the writing unit 6 are irradiated onto the surface of the photoconductor 4M during scanning, thereby forming an electrostatic latent image on the surface of the photoconductor 4M. The electrostatic latent image on the photoconductor 4M is developed by the developing device 5M and turned into a magenta toner image. At a transfer position through which the recording paper on the transfer belt 3 passes, the toner image on the photoconductor 4M is transferred onto the recording paper by a transfer bias applied by the transfer brush 28M. After the transfer of the toner image, the surface of the photoconductor 4M is applied a predetermined amount of lubricant by the brush roller 12M, and is cleaned by the cleaning blade 13M. Thereafter, the electric charge on the surface of the photoconductor 4M is removed for the next formation of the electrostatic latent image.

The developing device 5M uses a two-component developer containing a magnetic carrier and a negatively charged toner. A development sleeve 31M is arranged in the developing device 5M so as to be partly exposed from an opening on the photoconductor side of a development case 5*a*. The developing device 5M is further provided with transfer screws 5*b* and 5*c*, a development doctor blade 5*d*, a toner density sensor 5*e*, and a powder pump 270. The toner density sensor 5*e* is formed of a magnetic permeability sensor (T sensor) for detecting the magnetic permeability of the developer.

The developer stored in the developing device 5M is stirred and carried by the transfer screws 5*b* and 5*c*, so that the toner and the magnetic carrier are frictionally electrified in opposite polarities. A part of the developer is supported on the surface of the development sleeve 31, and after the thickness thereof is regulated by the development doctor blade 5*d*, the developer is carried to the development position facing the photoconductor 4M. At the development position, the toner in the developer on the development sleeve 31 moves toward the electrostatic latent image, due to the development field formed by the electrostatic latent image on the photoconductor 4M and the developing bias applied to the development sleeve 31. Accordingly, the electrostatic latent image on the photoconductor 4M is developed.

On the other hand, one sheet of the recording paper P as a recording medium from any one of the paper feed units 7 and 8 is separated, is passed through a resist roller pair 15 arranged on the paper feed side, and abuts against the photoconductor unit 2Y (see FIG. 1). The recording paper is then carried on the backside of the transfer belt 3, synchronized with the transfer timing of the respective color toner images, and reaches the transfer position facing the respective photoconductors 4Y, 4M, 4C, and 4Bk. At this transfer position, a transfer field is formed due to the effect of the bias applied to the transfer brush 28 arranged on the backside of the transfer belt 3. Due to the transfer field, the respective color toner images on the respective photoconductors 4Y, 4M, 4C, and 4Bk are sequentially transferred onto the recording material so as to be superposed on each other. To print a monochrome image, the black toner forms a toner image only on the photoconductor 4Bk in the black photoconductor unit 2Bk. The recording paper is carried on the transfer belt 3, synchronized with the transfer timing of the toner image, to transfer only the black toner image.

The recording paper onto which the respective color toner images are transferred in this manner is self-stripped from the transfer belt 3 at the position of the drive roller 22, and sent to the fixing device 30. When the recording paper passes a fixing nip in the fixing device 30, the respective color toner images are fixed on the recording paper due to heat and pressure. After fixation, the recording paper is ejected onto a paper ejection tray 10 provided on the upper side of the apparatus body, or delivered to a double-sided printing device 90 as shown in FIG. 1.

A process cartridge for replacement will be explained next with reference to FIG. 4. The top surface of the process cartridge for replacement is provided with a section to be detected for yellow, magenta, cyan, and black. Reflectors 45Y, 45M, 45C, and 45Bk (collectively referred to as "a reflector 45") of the cyan, yellow, magenta, and black are respectively provided in the section to be detected. These reflectors are arranged in the order of from yellow reflector 45Y, magenta reflector 45M, cyan reflector 45C, and black reflector 45Bk from right to left in the figure. Further, color display sections 46Y, 46M, 46C, and 46Bk as color display units for yellow, magenta, cyan, and black are arranged on a front side 44 of a process cartridge 40. The color display sections are also arranged in the order of from yellow, magenta, cyan, and black from right to left in the figure. The yellow reflector 45Y and the yellow display section 46Y are covered with a semitransparent tape 47. Likewise, the magenta reflector 45M and the magenta display section 46M, the cyan reflector 45C and the cyan display section 46C, and the black reflector 45Bk and the black display section 46Bk are respectively covered with a semitransparent tape. In the process cartridge, a yellow auxiliary mark 48Y is provided near the tape covering the yellow reflector 45Y and the yellow display section 46Y. Likewise, a magenta auxiliary mark 48M is provided near the tape covering the magenta reflector 45M and the magenta display section 46M, a cyan auxiliary mark 48C is provided near the tape covering the cyan reflector 45C and the cyan display section 46C, and a black auxiliary mark 48Bk is provided near the tape covering the black reflector 45Bk and the black display section 46Bk.

Figure 5:
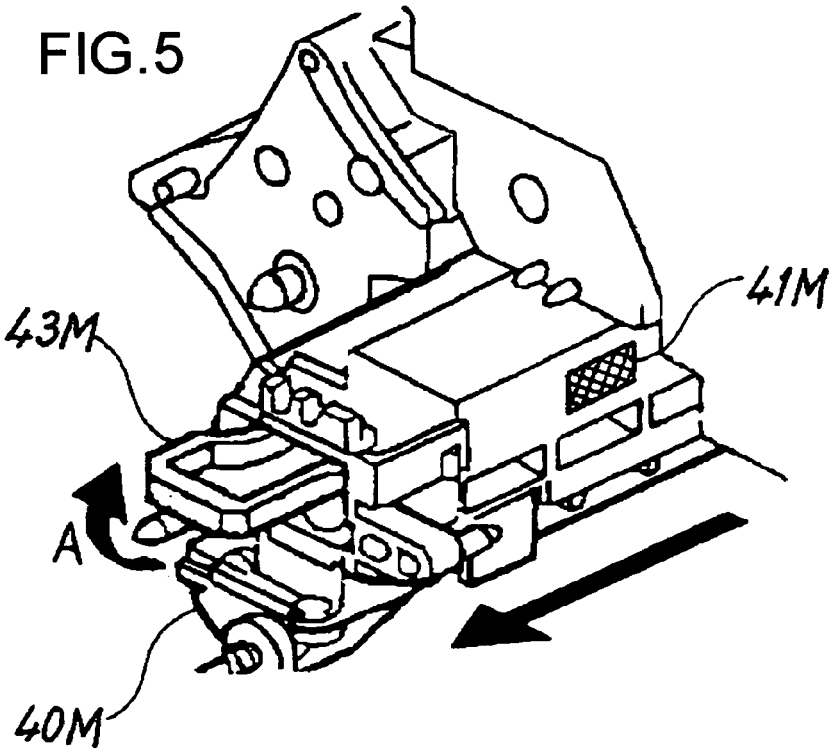
FIG. 5 illustrates a state in which a magenta process cartridge is pulled out from a station.

A pull-out lever 43 is provided on the front side 44. As shown in FIG. 5, when the process cartridge is fitted inside the apparatus body, the pull-out lever 43 is bent upward as shown by arrow A in FIG. 5. When the process cartridge 40 is pulled out from the apparatus body, the pull-out lever 43 is brought down to the front side 44, so that the process cartridge 40 can be easily pulled out. An IC tag 41 is provided on the side of the process cartridge.

Figure 6:
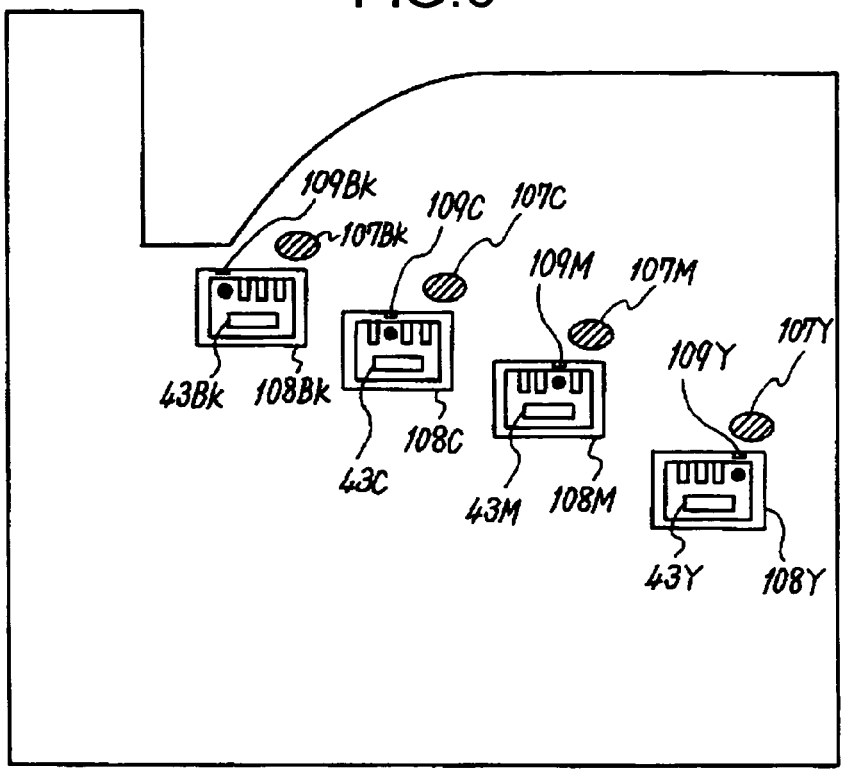
FIG. 6 is a schematic block diagram of the process cartridge installed in the image forming apparatus.

As shown in FIG. 6, stations 108Y, 108M, 108C, and 108Bk (collectively referred to as "a station 108") into which the yellow, magenta, cyan, and black process cartridges 40 are respectively inserted, are provided in the image forming apparatus body. Station color display sections 107Y, 107M, 107C, and 107Bk corresponding to the respective toner colors are respectively provided near the opening of the respective stations 108Y, 108M, 108C, and 108Bk. As shown in FIG. 6, since the color display sections are provided on the front side 44 of the process cartridge 40, when the user opens the door of the apparatus body, the user can confirm whether the process cartridge is installed in the correct station, merely by comparing the color display sections 46Y, 46M, 46C, and 46Bk in the respective process cartridges with the station color display sections 107Y, 107M, 107C, and 107Bk.

Figure 7:
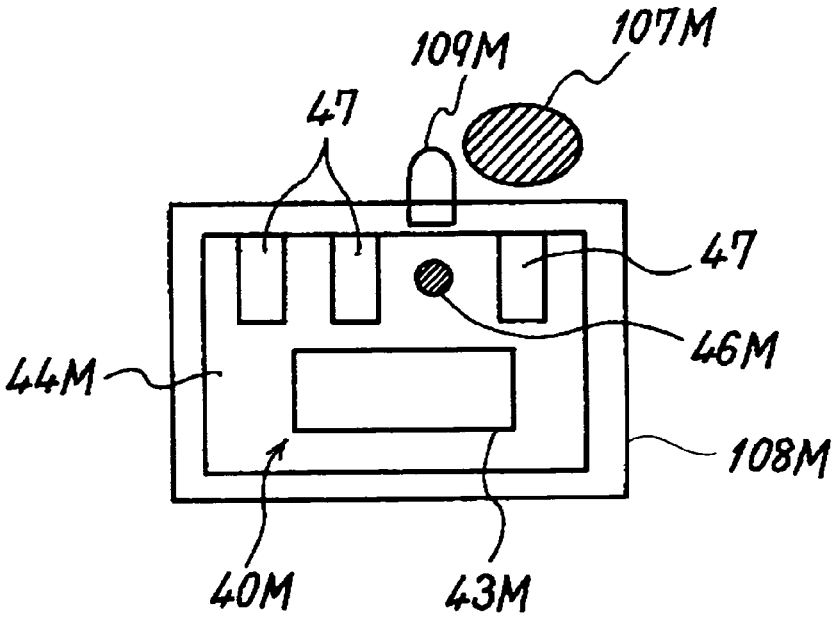
FIG. 7 is a schematic block diagram of the magenta process cartridge installed in the image forming apparatus.

A method of replacing the process cartridge will be explained below. For example, when life of the magenta process cartridge 40M ends, the user opens the door of the apparatus body, and pulls out the process cartridge to be replaced from the magenta station 108M. At this time, the user confirms which process cartridge is to be pulled out, from the station color display section 107M provided near the opening of the magenta station 108M, and the color display section 46M provided on a front side 44M of the magenta process cartridge 40M. As shown in FIG. 5, the user then brings the pullout lever down to the front side, to pull out the magenta process cartridge 40M. The user then takes out the process cartridge for replacement shown in FIG. 4, finds a tape to be peeled following an indication of the auxiliary mark 48, and peels the tape on the front side of the auxiliary mark 48. The magenta reflector 45M and the color display section 46M are thus exposed. The magenta reflector 45M and the color display section 46M are of magenta. Accordingly, the user can easily recognize that this process cartridge for replacement is for replacement of magenta. The user then inserts the process cartridge for replacement of magenta into the apparatus body. At this time, the user compares the station color display section 107M provided near the opening of the magenta station 108M with the color display section 46M, to confirm that these are the same color. The user installs the process cartridge in the apparatus body, to render the process cartridge the state shown in FIG. 7. At this time, the magenta reflector 45M faces a reflective photo sensor 109M. Likewise, reflective photo sensors 109Y, 109C, and 109Bk are installed in other stations. The IC tag 41M also faces an antenna (not shown) provided within the magenta station 108M. When the user closes the door of the apparatus body, the reflective photo sensor 109M detects the color of the magenta reflector 45M. If the process cartridge is installed without peeling the seal, or if the process cartridge is installed by peeling a tape of a mismatching color, the amount of light detected by the reflective sensor becomes different, and hence a voltage value output to a central processing unit (CPU) (described later) becomes different. Accordingly, it is detected that a process cartridge of a mismatching color has been inserted into the magenta station 108M. Thus, when a process cartridge of a mismatching color is installed, the user is informed of the state by an alarm display, and the image forming operation is suspended. Further, the apparatus body and the IC tag 41M communicate, to write the color ID. If the process cartridge has not been installed correctly in the station, the communication is not performed well, and an alarm is displayed.

Figure 8:
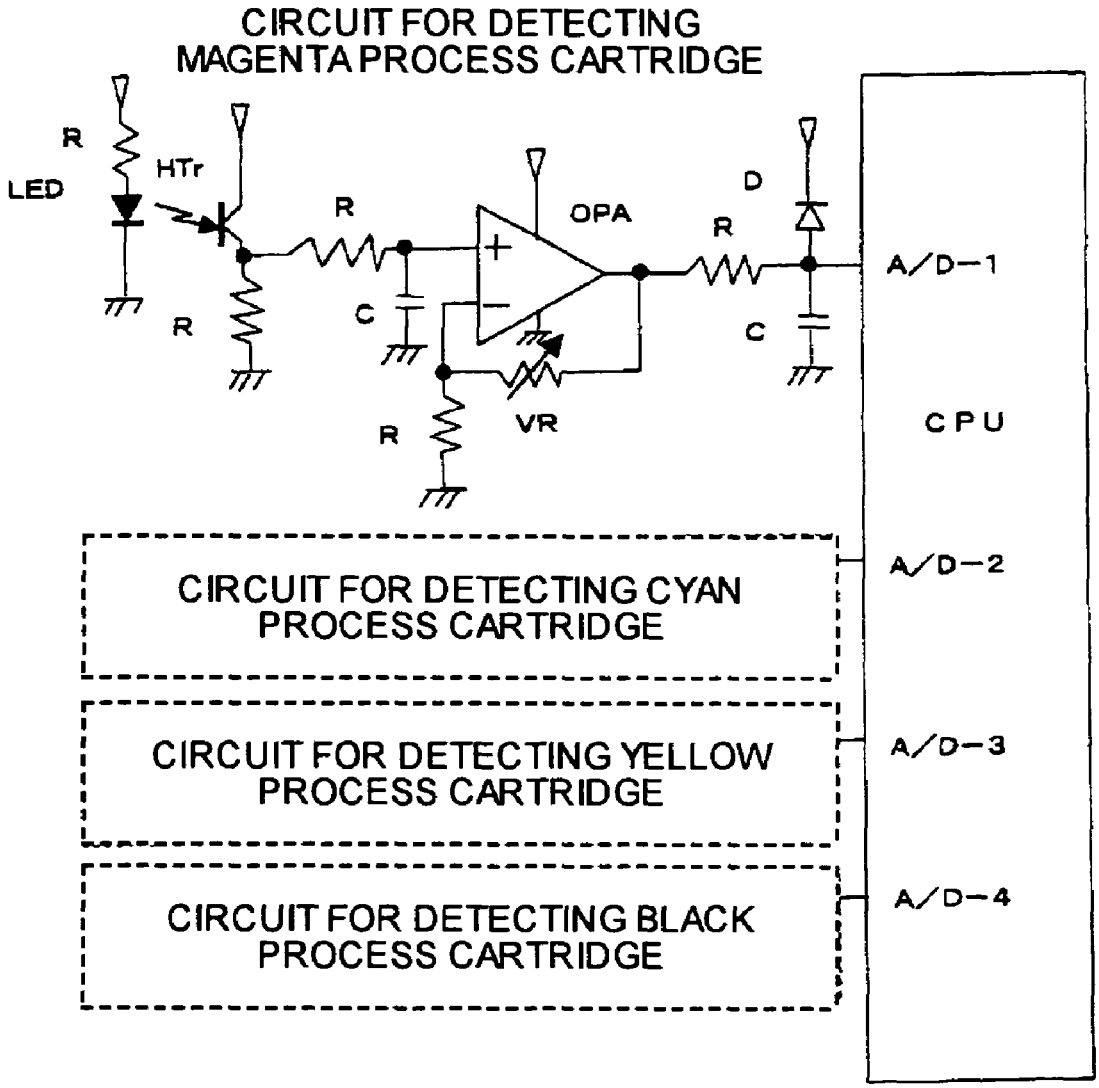
FIG. 8 illustrates a detection circuit that detects the color of the magenta process cartridge.

FIG. 8 illustrates a detection circuit that detects a color of the respective process cartridges. In FIG. 8, a circuit that detects a color of the magenta process cartridge is shown in detail, but the circuits for cyan, yellow, and black have the same configuration. The magenta reflector 45M of the process cartridge 40M reflects light from a light-emitting diode (LED), and the light is made to enter into a phototransistor (Htr). A different photocurrent flows in the Htr based on the intensity of the reflected light, and the output voltage thereof is input to a non-inverting input terminal of an operational amplifier (OPA) via a resistance (R). The input voltage is amplified by the OPA, and input to an input terminal of an A/D converter in the CPU. A voltage corresponding to the reflected light from the magenta reflector 45M is pre-stored in a memory of the CPU, and the pre-stored voltage is compared with the voltage input to the A/D converter, to confirm whether the magenta process cartridge 40M has been inserted in the magenta station 108M. If the voltage values are different from each other, an alarm display is provided to indicate that the tape 47 was peeled from a wrong position, or the process cartridge was installed in a mismatching station. If the difference between the A/D converter input voltage and the pre-stored voltage value is more than twice, and when the tape 47 is not peeled, the light incident to the Htr becomes about half due to the semitransparent tape, and hence a voltage value detected is half the pre-stored voltage value. In this case, an alarm display is provided to peel a tape corresponding to the color of the station in which the process cartridge is installed. Further, if the process cartridge has not been correctly installed in the apparatus body, the light incident to the Htr decreases, and hence, a voltage value lower than the pre-stored voltage value is detected. In this case, an alarm display indicating that the process cartridge has not been correctly installed is provided.

Figure 9:
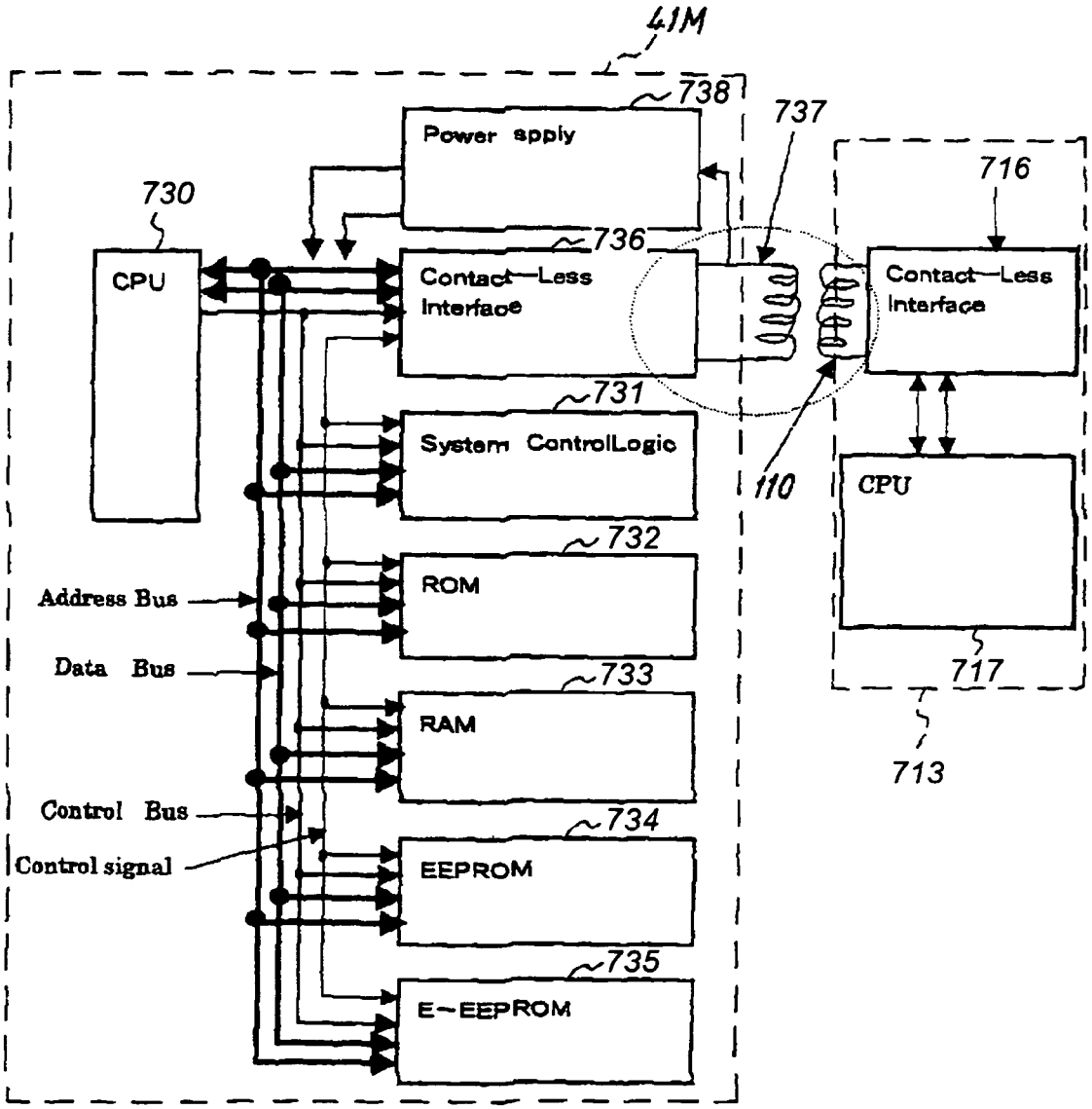
FIG. 9 is a block diagram of an IC tag attached to the process cartridge.

The IC tag 41M attached to the magenta process cartridge performs contact-less communication with the apparatus body. FIG. 9 is a block diagram of the IC tag attached to the magenta process cartridge. IC tags for cyan, yellow, and black have the same configuration. A receiver provided on the image forming apparatus body side shown in FIG. 9 is housed in an I/O control board 713 in the apparatus body, and includes a CPU 717 and a contact-less communication unit 716. The CPU 717 and the contact-less communication unit 716 are connected via a serial interface. On the other hand, the IC tag 41M includes a CPU 730, a system control logic 731, a read only memory (ROM) 732, a random access memory (RAM) 733, an EEPROM 734, an E-EEPROM 735, a contact-less communication unit 736, a transmission/reception antenna 737, and a power supply 738 that rectifies electromagnetic waves from the transmission/reception antenna 737 to supply power. The CPU 730 communicates with a receiver on the apparatus body side, and reads and writes from/to the EEPROM 734 based on a command from the receiver, via the ROM 732 (program) stored therein. The system control logic 731 is a circuit that controls the inside of the IC tag 41M. The EEPROM 734 is a nonvolatile memory that stores information required to control the process cartridge, and stores imaging conditions such as exposure amount, charged amount, and developing bias, cartridge lot, production date, type, retention period, serial number, activation date, number of copies, replacement time of cartridge components, toner lot, filled amount, filled time, manufacturer's name, and the like. Abnormality of a T sensor and abnormality of a unit such as abnormal charging may be stored in the memory and used later for checking at the time of reusing the process cartridge and for examining if parts of the process cartridge need to be replaced. The E-EEPROM 735 stores exclusive commands to be written in the EEPROM 734.

A signal output from the CPU 717 on the apparatus body side is modulated by the contact-less communication unit 716 on the body side, to a predetermined signal for transmission, and sent to an antenna 110 for transmission and/or reception. The transmission/reception antenna 737 on the process cartridge side receives the signal sent from the antenna 110 on the apparatus body side. The contact-less communication unit 736 on the process cartridge side demodulates the signal from the predetermined signal for transmission, converts to a parallel signal, and sends the parallel signal to the CPU 730. The same operation is performed when a signal is transmitted from the CPU 730 in the IC tag 41M on the process cartridge side to the apparatus body side by the contact-less communication unit 736.

Figure 10:
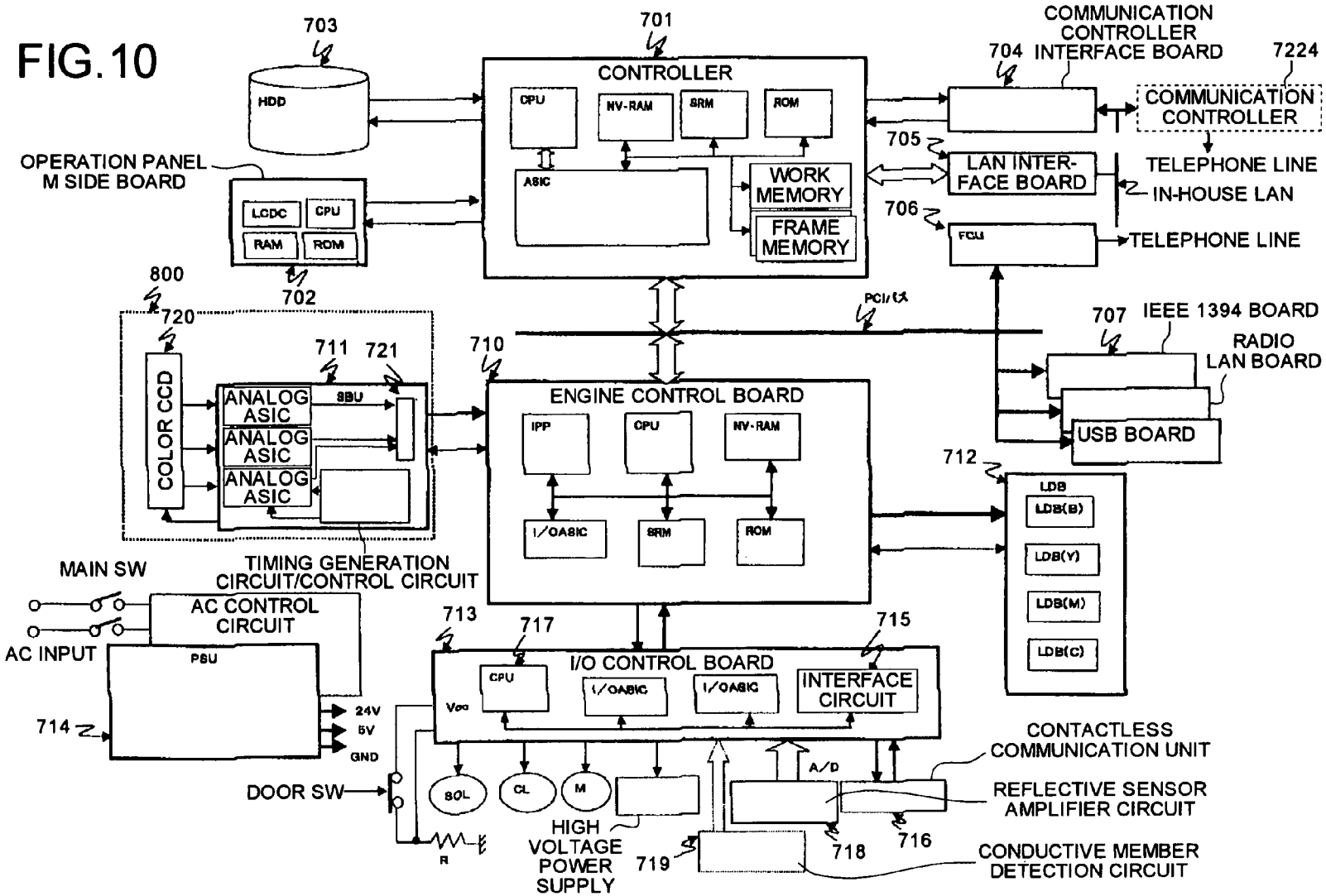
FIG. 10 is a block diagram of a controller in the image forming apparatus.

FIG. 10 is a block diagram of a part of an electric circuit of the image forming apparatus. A controller board 701 performs a plurality of application functions such as scanning, facsimile, printing, and copying, and controls the whole system. The controller board 701 includes a CPU, a ROM that controls the system controller board, a static RAM (SRAM) being a work memory used by the CPU, a frame memory, and a work memory. Further, the controller board 701 includes a non-volatile RAM (NV-RAM) having a backup function of the SRAM, and having a lithium battery built therein, an application specific integrated circuit (ASIC) for controlling the peripherals of the CPU such as first-in first-out (FIFO) memory, and an interface circuit thereof. To the controller board 701 are connected an operation board 702 of the image forming apparatus and a hard disk drive (HDD) 703 for recording image data.

The operation board 702 controls input when a user operates a panel of the image forming apparatus to input system setting, and controls a display for displaying the set content and the state of the system for the user. A CPU, a RAM, being a work memory used by the CPU, a ROM in which a control program for controlling input read and display output on the operation board 702, a liquid crystal display (LCD) for displaying the set content and the state, an ASIC (LCDC) for controlling key input, and the like are installed on the operation board 702.

The HDD 703 is used as application database for storing the application program of the system and equipment energization information of imaging process equipment of a printer. The HDD 703 is also used as image database for storing image data of read image and write image, and document data. The HDD 703 and the controller board 701 are connected via an interface conforming to ATA/ATAPI-4 for both physical interface, and electric interface.

To the controller board 701 are also connected a communication controller interface board 704 that performs communication with outside by using an analog circuit (telephone line), and a local area network (LAN) interface board 705. Communication with the control system is performed via the communication controller interface board 704 and the LAN interface board 705. The communication controller interface board 704 is a communication interface board between a communication controller 7224 and the controller board 701, and communication with the controller board 701 is performed by full-duplex asynchronous serial communication. Further, the connection between the controller board 701 and the communication controller 7224 is a multidrop connection, conforming to the RS-485 interface standard. The LAN interface board 705 is a communication interface board between the in-house LAN (the Internet) and the controller board 701. The LAN interface board 705 is connected via a standard communication interface such as PHY chip I/F and 12C bus I/F.

Further, a general-purpose peripheral component interconnect (PCI) bus is connected to the controller board 701, and to the PCI bus are connected a FAX control unit (FCU) 706, an IEEE 1394 board, a radio LAN board, and a universal serial bus (USB) board 707. The PCI bus is an image data bus and control command bus, so that image data and a control command are transferred in a time-sharing manner.

An engine control board 710 is also connected to the PCI bus, and the engine control board 710 and the controller board 701 are connected via the PCI bus. The engine control board 710 mainly controls the image forming operation of the image forming apparatus, and is installed with a CPU, an Internet printing program (IPP) being a programmable arithmetic processing unit for performing image processing, a ROM having a built-in program necessary for controlling the copying and printout operation, an SRAM necessary for the control of the ROM, and an NV-RAM. The NV-RAM is installed with an SRAM and a memory for storing a detection result of power OFF in an EEPROM. The engine control board 710 also includes a serial interface for transferring a signal to/from a CPU that performs other controls. An I/O ASIC for controlling nearby I/O (counter, fan, solenoid, motor and the like) installed with the engine control board is also installed in the engine control board 710.

To the engine control board 710 are connected an I/O control board 713 for controlling I/O of the image forming apparatus, a scanner (SBU) board for reading a document (image) to be copied, and an LDB board 712 for writing the image data on the photoconductor. The I/O control board 713 is installed with an I/O ASIC for controlling I/O of the image forming apparatus including analog control, and a sub CPU. The I/O control board 713 is connected with the contact-less communication unit 716 that communicates with an IC tag attached to the process cartridge. The I/O control board 713 is also connected with a reflective sensor circuit 718 that detects the color detection mark on the process cartridge, and a conductive member detection circuit 719. The I/O control board 713 and the engine control board 710 are connected via a synchronous serial interface.

The SBU board 711 includes an analog ASIC, a charge coupled device (CCD), and a circuit that generates drive timing of the analog ASIC.

Further, a power supply unit (PSU) 714 that supplies power for controlling the image forming apparatus is provided. A main SW supplies primary power to the PSU 714.

The control of the image forming apparatus will be explained below. At first, an original document is set on a read unit 800 that optically reads the document, and that includes a color CCD. 720 and an SBU board 711. The document (not shown) provided in the read unit is scanned with a light source, to irradiate light onto the document. The light reflected from the document is photo-electrically converted by the color CCD 720 to create an image signal. The color CCD 720 is a 3-line color CCD, and creates RGB image signals of EVENch/ODDch. The R, G, and B image signals are respectively input to the analog ASIC in the SBU board 711 corresponding to the respective image signals. The R, G, and B image signals output from the CCD are sampled, and held by a sample-and-hold circuit in the analog ASIC, A/D converted, and converted to a data signal, respectively. The respective R, G, and B analog ASICs perform shading correction with respect to the data signals, and the data signals are sent out to an image processor IPP in the engine control board 710 via the image data bus of the output interface (I/F) 721. The image data transferred from the SBU board 711 to the IPP is written in the frame memory in the controller board 701 via the image data bus of the PCI bus, after correcting signal deterioration (signal deterioration in a scanner system) due to the optical system and quantization of the digital signal.

Write signals corresponding to black (B), yellow (Y), cyan (C), and magenta (M) output from the work memory in the controller board 701 are respectively input to the respective black, yellow, magenta, and cyan LD write circuits (LDB) of the LDB board 712. In the LD write circuits (LDB) for the respective colors, LD current control (modulation control) is carried out by the LD write circuits (LDB) for the respective colors, and the write signals are respectively output to the LDs for the respective colors, to thereby write with the laser beams on the surface of the photoconductors for the respective colors.

The color detection control for the process cartridge will be explained below. When the door of the apparatus body is opened and closed for replacing the process cartridge by a new process cartridge, a door SW attached to the door is also opened and closed. The door SW is connected to an I/O control board 713, and when the door SW is opened and closed, the sub CPU in the I/O control board 713 recognizes the replacement of the process cartridge, and activates a circuit that detects the color detection mark of the process cartridge. The result thereof is transmitted from the I/O control board 713 to the engine control board. At the same time, the information about the process cartridge is obtained through the IC tag attached to the process cartridge and the contact-less communication unit 716. An interface circuit 715 of the I/O control board 713 performs this communication.

When the main SW is turned on, color detection control for the process cartridge is also executed.

Color detection confirmation control in the process cartridge will be explained based on the flowchart shown in FIG. 11. When the door of the apparatus body is opened and closed, or the main SW is turned on, a color detection confirmation circuit of the process cartridge is activated. At first, the CPU in the image forming apparatus checks if the door of the apparatus body is open (step F1-1). If the door is open (Yes at step F1-1), a door open flag is set (step F1-2). Communication with the memory in the IC tag attached to the process cartridge is suspended (step F1-3). Power supply to the process cartridge is then stopped (step F1-4), and color detection confirmation control in the process cartridge is not executed. On the other hand, if the door of the apparatus body is not open (No at step F1-1), it is checked if the door open flag has been set (step F1-5). If the door open flag has been set (Yes at step F1-5), the color of the respective process cartridges is read (step F1-6). It is then checked if the process cartridges corresponding to the respective stations of yellow, magenta, cyan, and black are correctly installed, by comparing a prerecorded voltage value with a voltage value detected by the color detector (step F1-7). If the process cartridges corresponding to the respective stations of yellow, magenta, cyan, and black are correctly installed (Yes at step F1-7), it is then checked if a color ID has been recorded in the memory in the IC tag (step F1-13). If the color ID has been recorded (Yes at step F1-13), the process cartridge is correctly installed, and the color detection confirmation control in the process cartridge ends. On the other hand, if there is no record of the color ID in the memory in the IC tag (step F1-16), the color ID is stored in the memory in the IC tag (step F1-17), and the color detection confirmation control in the process cartridge ends. If the color ID stored in the memory in the IC tag is different from the color ID stored in the apparatus body (step F1-14), an alarm is displayed to confirm the detached member (step F1-15), and a copy start button is turned to red, to suspend the copy operation (step F1-10). The door flag and the power ON flag are then cleared (step F1-11), the power supply to the process cartridge and communication with the memory in the IC tag are resumed (step F1-12), and the color detection confirmation control in the process cartridge ends.

If the prerecorded voltage value is different from the voltage value detected by the color detector, that is, if at least one of the process cartridges of the colors corresponding to the yellow, magenta, cyan, and black stations has not been correctly installed (No at step F1-7), an alarm to confirm the installation position of the process cartridge (step F1-8) and an alarm to confirm the position for peeling the tape (step F1-9) are displayed, corresponding to a difference between the prerecorded voltage value and the voltage value detected by the color detector. The copy start button is then turned to red, so that the image forming operation cannot be performed, and the copy operation is suspended (step F1-10). The door flag and the power ON flag are then cleared (step F1-11), the power supply to the process cartridge and communication with the memory in the IC tag are resumed (step F1-12), and the color detection confirmation control in the process cartridge ends. If the door open flag has not been set (No at step F1-5), it is checked if a power ON flag has been set in an initialization routine at the time of turning on the power (step F1-18). If the power ON flag has been set (Yes at step F1-18), the color of the respective process cartridges is read by the color detector (step F1-6), and the flow from step F1-6 onward is executed. If the power ON flag has not been set (No at step F1-18), the control ends.

The color detection confirmation control in the process cartridge may be performed according to a flowchart shown in FIG. 12, instead of the flowchart shown in FIG. 11. In the color detection confirmation control shown in FIG. 12, communication is performed with the IC tag, before detecting the installation position of the process cartridge by the color detector, to confirm whether the process cartridge has been installed in the apparatus body. When the door of the apparatus body is opened and closed, or the main SW is turned on, the color detection confirmation circuit of the process cartridge is activated. At first, the CPU in the image forming apparatus checks if the door of the apparatus body is open (step F2-1). If the door is open (Yes at step F2-1), the door open flag is set (step F2-2). Communication with the nonvolatile memory in the IC tag attached to the process cartridge is then suspended (step F2-3). Power supply to the process cartridge is also suspended (step F2-4), and the color detection confirmation control in the process cartridge is not executed. On the other hand, if the door of the apparatus body is not open (No at step F2-1), it is checked if the door open flag has been set (step F2-5). If the door open flag has been set (Yes at step F2-5), the ID is confirmed in the IC tags for the four colors, and it is checked if communication has been established (step F2-6). If the communication has not been established (No at step F2-6), an alarm is displayed to confirm whether the process cartridge has been installed (step F2-19), and the copy start button is turned to red, to suspend the copy operation (step F2-10). If the communication has been established (Yes at step F2-6), the process cartridges have been installed in the yellow, magenta, cyan, and black stations, and the color detector confirms the installation of the respective process cartridges (step F2-7). It is then checked if the process cartridges corresponding to the respective stations of yellow, magenta, cyan, and black are correctly installed, by comparing a prerecorded voltage value with a voltage value detected by the color detector (step F2-8). If the process cartridges corresponding to the respective stations of yellow, magenta, cyan, and black are correctly installed (Yes at step F2-8), it is then checked if a color ID has been recorded in the memory in the IC tag (step F2-14). If the color ID has been recorded (Yes at step F2-14), the process cartridge is correctly installed, and the color detection confirmation control in the process cartridge ends. On the other hand, if there is no record of the color ID in the memory in the IC tag (step F2-17), the color ID is stored in the memory in the IC tag (step F2-18), and the color detection confirmation control in the process cartridge ends. If the color ID stored in the memory in the IC tag is different from the color ID stored in the apparatus body (step F2-15), an alarm is displayed to confirm that the detachable member has been detached (step F2-16), and the copy start button is turned to red, to suspend the copy operation (step F2-10). The door flag and the power ON flag are then cleared (step F2-11), to resume power supply to the process cartridge and communication with the memory in the IC tag (step F2-12), and the color detection confirmation control in the process cartridge ends.

If the prerecorded voltage value is different from the voltage value detected by the color detector, that is, when at least one of the process cartridges of the colors corresponding to the yellow, magenta, cyan, and black stations has not been correctly installed (No at step F2-8), an alarm to confirm the installation position of the process cartridge (step F2-9) and to confirm the position of the peeling tape (step F2-9) are displayed, corresponding to a difference between the prerecorded voltage value and the voltage value detected by the color detector. The copy start button is then turned to red, so that the image forming operation cannot be performed, and the copy operation is suspended (step F2-10). The door flag and the power ON flag are then cleared (step F2-11), to resume power supply to the process cartridge and communication with the memory in the IC tag (step F2-12), and the color detection confirmation control in the process cartridge ends. If the door open flag has not been set (No at step F2-5), it is checked if the power ON flag has been set in the initialization routine at the time of turning on the power.(step F2-13). If the power ON flag has been set (Yes at step F2-13), the color of the respective process cartridges is read by the color detector, to execute the flow at step F2-6 onward. If the power ON flag has not been set (No at step F2-13), the control process ends.

Figure 4:
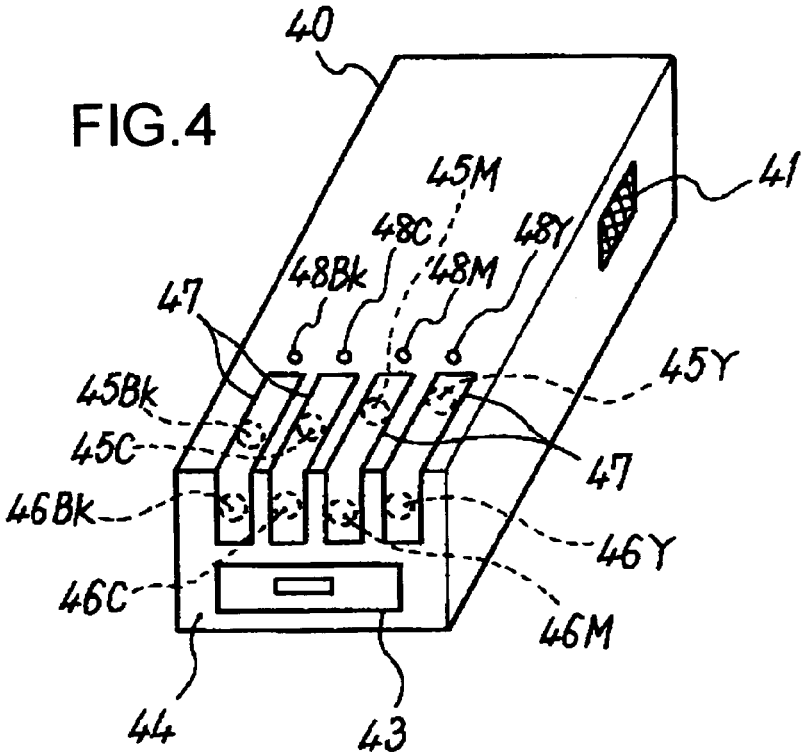
FIG. 4 illustrates the process cartridge.

In the process cartridge shown in FIG. 4, the respective reflectors 45Y, 45M, 45C, and 45Bk are reflectors for the yellow, magenta, and cyan black, but the reflectors are not limited thereto. For example, the reflectors 45Y, 45M, 45C, and 45Bk may be mirror bodies. In this case, the amount of reflected light from the LED increases, thereby enabling reliable detection.

Figure 13:
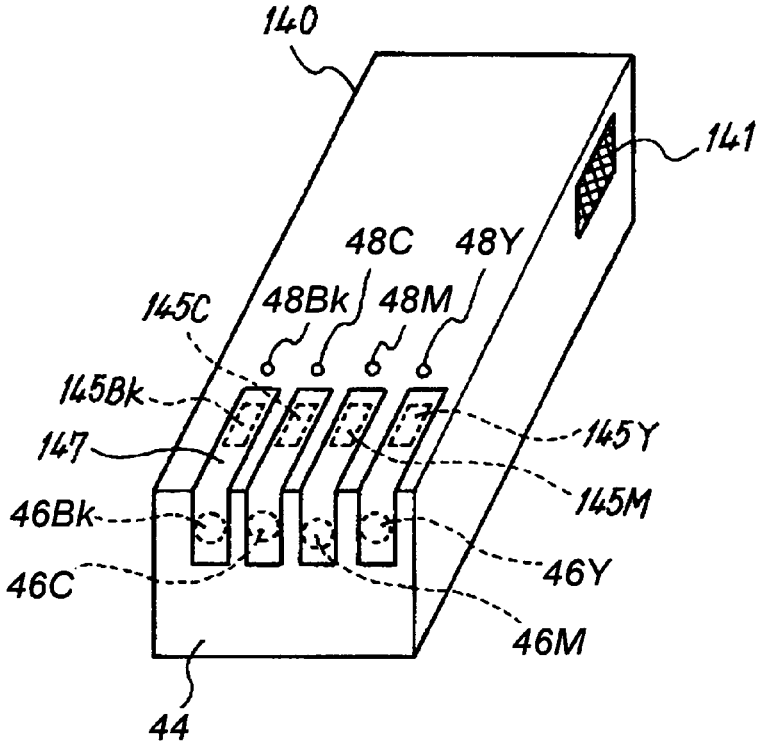
FIG. 13 is a schematic block diagram of a process cartridge according to another embodiment.
Figure 14:
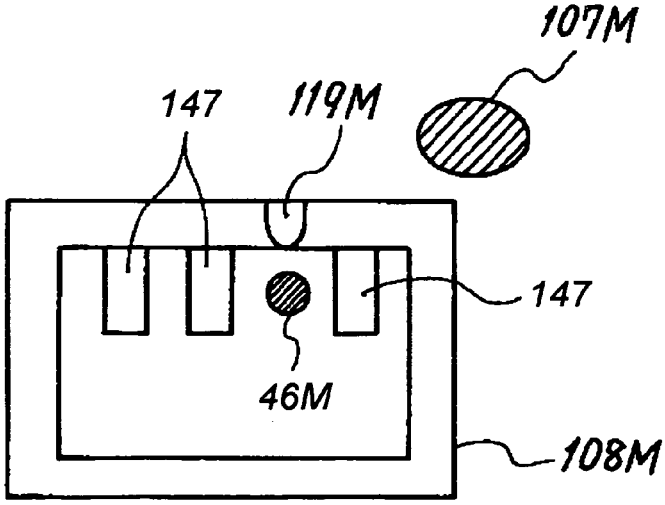
FIG. 14 is a schematic block diagram of the magenta process cartridge, that is shown in FIG. 13, and installed in the image forming apparatus.

In the above explanation, the process cartridge shown in FIG. 4 has been explained as an example, but the process cartridge is not limited thereto. For example, as shown in FIG. 13, a process cartridge 140 in which a conductive member 145 such as a phosphor bronze plate is used instead of the reflector 45 may be used. As shown in FIG. 13, conductive members. 145Y, 145M, 145C, and 145Bk are provided at the positions of the reflectors shown in FIG. 4. The surfaces of the conductive members are respectively painted in the yellow, magenta, and cyan black. For example, when the magenta process cartridge 140M is installed in the magenta station, as shown in FIG. 14, a connecting section 119M provided in the station comes in contact with the conductive member. For yellow, cyan, and black, the configuration is the same (collectively referred to as "connecting section 119"). A tape 147 to be used is a nonconductive tape, so that even if a process cartridge of a mismatching color is installed in the station, the connecting section and the conductive member do not become conductive to each other.

Figure 15:
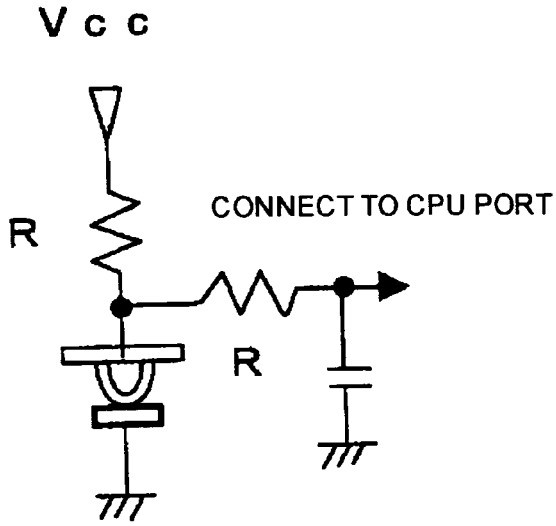
FIG. 15 illustrates a detection circuit of the process cartridge shown in FIG. 13.

FIG. 15 is a circuit diagram of the color detector in the process cartridge shown in FIG. 13. When the process cartridge is correctly installed in the right station, the connecting section 119 and the conductive member 145 come in contact with each other. The conductive member 145 comes in contact with a lead extending into the process cartridge and is connected to the GND. Accordingly, the electric current flowing from a voltage source located on the upstream side of the connecting section 119 is removed to the GND via the conductive member 145, so that the current does not flow to the CPU port. Thus, the voltage value of the CPU port becomes zero, thereby detecting that the process cartridge is correctly installed. On the other hand, when a process cartridge of a mismatching color is installed in the station 108, the conductive member 145 and the connecting section 119 are not connected to each other, and a Vcc voltage is applied to the CPU port, thereby detecting that a process cartridge of a mismatching color is installed in the station.

An IC tag 141 is also provided in the process cartridge shown in FIG. 13. Communication is then performed with the apparatus body, to compare the color stored in the apparatus body with the color stored in the memory in the IC tag. If the colors are mismatching with each other, an alarm is displayed to suspend the image forming operation. If there is no record of color in the memory in the IC tag, the color is recorded in the memory in the IC tag.

In this embodiment, the process cartridge having the developing device and another image forming processing unit has been explained, but the present invention is not limited thereto. For example, the present invention is also applicable to a developing device and a toner cartridge detachable from the image forming apparatus shown in FIG. 3, and a development unit including the developing device and the toner cartridge.

According to the image forming apparatus in this embodiment, the color display section for displaying the color of the toner stored in the developing device in the process cartridge is provided in the process cartridge. Therefore, a user can recognize which color toner is stored in the developing device in the process cartridge, only by seeing the process cartridge. Hence, a situation where a process cartridge for a mismatching color toner is installed in the station in the image forming apparatus can be avoided. Further, a reflector is provided in the process cartridge, and a detector that detects the reflector when the process cartridge is installed in the station is provided in the station. Hence, even if a process cartridge of a mismatching color is installed in the station, the detector detects the mistake. Therefore, such a situation can be avoided where a user operates the image forming apparatus without noticing that a process cartridge of a mismatching color has been installed in the station, and as such, mixing of a mismatching color toner in the developing device of the process cartridge is also avoided.

Moreover, color display sections for yellow, magenta, and cyan black are provided in the process cartridge, and these color display sections are respectively covered with a tape as a shielding member. When the process cartridge is replaced, by peeling the tape covering the color display section of the same color as that of the station in which the process cartridge is to be installed, the process cartridge can be rendered the same color as that of the station in which the process cartridge is to be installed. Accordingly, one process cartridge can be used for all colors. Thus, it is not necessary for the user to store process cartridges for each color, thereby reducing the load on management of the user.

Furthermore, yellow, magenta, and cyan black reflectors are provided in the process cartridge, and these reflectors are respectively covered with a tape as a shielding member. When the process cartridge is replaced, by peeling the tape covering the reflector of the same color as that of the station in which the process cartridge is to be installed, the process cartridge can be rendered the same color as that of the station in which the process cartridge is to be installed. Accordingly, one process cartridge can be used for all colors. Thus, it is not necessary for the user to store process cartridges for each color, thereby reducing the load on management of the user. When the process cartridge is installed in the station, the reflective sensor in the station is fitted in a position facing the reflector of the same color as that of the station. Thus, when a process cartridge of a mismatching color is installed in the station, the reflective sensor detects the tape, thereby detecting that a process cartridge of a mismatching color has been installed. On the other hand, when a process cartridge of the same color as that of the station is installed in the station, the reflective sensor detects the reflector, thereby detecting that a process cartridge has been installed in the correct position.

Moreover, the yellow reflector and the yellow display section are covered with one semitransparent tape. Likewise, the magenta reflector and the magenta display section, the cyan reflector and the cyan display section, and the black reflector and the black display section are respectively covered with one semitransparent tape. Thus, by peeling only one tape, the color display section and the reflector of the same color can be exposed, thereby reducing the time and labor of the user required for the replacement.

Furthermore, the member to be detected is formed of a conductive member, and a detecting member is a connecting section, and whether the process cartridge is installed in the correct position can be detected by the conductive state between the connecting section and the conductive member. Further, the tape covering the conductive member is a nonconductive tape. As a result, even if a process cartridge of a mismatching color is installed in the station, conduction with the conductive member can be reliably prevented. Consequently, more precise detection is possible.

Moreover, the auxiliary mark is provided near the tape covering the reflector and the color display section of the process cartridge. Therefore, the user can recognize which color reflector and color display mark are exposed after peeling which tape. Thus, an error in peeling the tape can be avoided.

Further, the reflective optical sensor detects the color of the reflector. Therefore, it can be detected that the process cartridge is installed in the position for the same color as that of the station, thereby preventing erroneous installation.

Furthermore, the tape covering the reflector and the color display section is semitransparent. Therefore, because the color display section is visible through the tape, the user can recognize which color reflector and color display mark will be exposed after peeling which tape. Thus, an error in peeling the tape can be avoided.

Moreover, a voltage value output by the reflective optical sensor is compared with a voltage value pre-stored in the apparatus body. If these do not match with each other, it is determined that a process cartridge of a mismatching color has been installed in the station, and the image forming operation is suspended. Accordingly, such a situation can be avoided where the user wrongly starts the copying operation, and the toner stored in the developing device is mixed with another color toner.

Furthermore, a voltage value detected by the detector is compared with a voltage value pre-stored in the apparatus body, to detect the installation state of the process cartridge. Accordingly, it is detected whether the process cartridge is installed in the position for the same color as that of the station, and also the installation state of the process cartridge due to a difference between the voltage values is detected. For example, if the difference between the voltage output from the detector and the voltage value pre-stored in the apparatus body is more than twice, it can be detected that the seal is peeled at two or more positions, or when there is almost no voltage difference, it can be detected that the process cartridge has not been installed in the station. Accordingly, a precise alarm can be displayed for the user.

Moreover, the IC tag is attached to the process cartridge, and when communication is not established between the IC tag and the apparatus body, the image forming operation is suspended. When the communication with the IC tag is not established, it shows that the process cartridge has not been installed in the station, or has not been correctly installed. If the image forming operation is performed under such a state, a problem may occur in the apparatus. However, in this embodiment, suspending the image forming operation avoids occurrence of a problem in the apparatus. Further, after the communication with the IC tag has been established, the voltage value detected by the detector is compared with the voltage value pre-stored in the apparatus body, to detect the installation state of the process cartridge. Accordingly, it can be detected whether the process cartridge has been installed in the station, or that the process cartridge has been installed in a wrong position, and a precise alarm can be displayed.

Further, if the color ID is not found in the IC tag, the color ID is stored in the IC tag. Accordingly, when the life of the process cartridge ends and the process cartridge is recycled, it can be recognized which color toner had been stored in the developing device, by reading the information stored in the IC tag.

Furthermore, because the color display section is provided in the developing device, the toner color stored in the developing device can be displayed on the developing device. Accordingly, the user can recognize which color toner is stored in the developing device only by seeing the developing device. Therefore, installing a developing device storing a mismatching color toner in the installation section for the developing device in the image forming apparatus can be avoided. Further, even if a developing device storing a mismatching color toner is installed in the installation section for the developing device in the image forming apparatus, the detector can detect the error. By the detection result, the image forming operation is suspended, or the user is informed that a developing device storing a mismatching color toner has been installed. Therefore, a situation where a user operates the image forming apparatus without noticing that a process cartridge of a mismatching color has been installed in the installation section for the developing device, and as such, mixing of a mismatching color toner in the developing device of the process cartridge is avoided.

Another embodiment of the present invention will be explained below. In the above embodiment, the process cartridge 40 shown in FIG. 4 and the process cartridge 140 shown in FIG. 13 have been explained. In this embodiment, a process cartridge 240 shown in FIG. 19 will be used for explanation.

Figure 16:
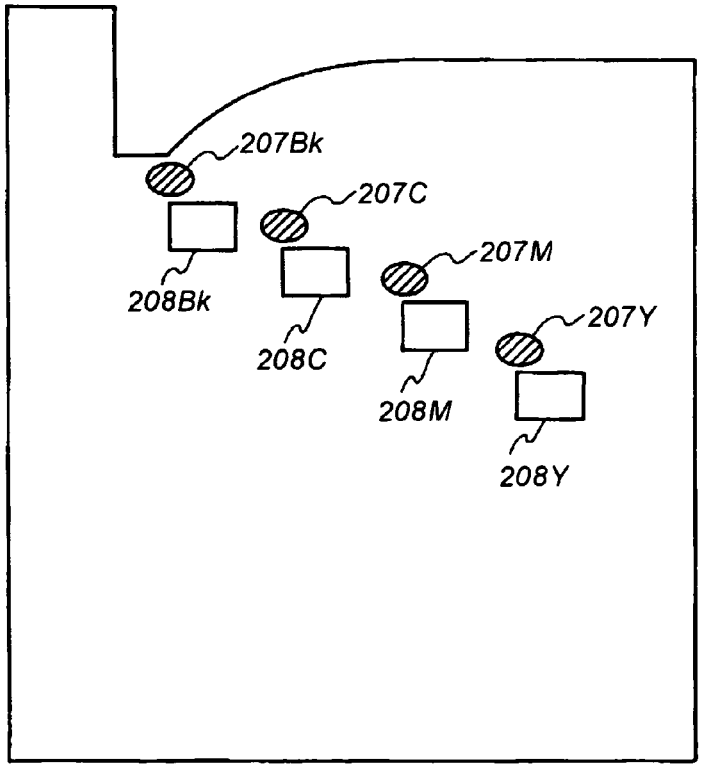
FIG. 16 is a schematic block diagram of a station opening and a color display section.
Figure 17:
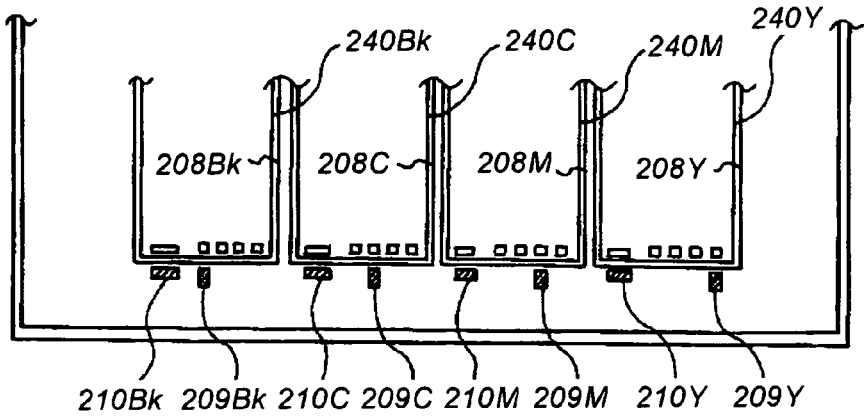
FIG. 17 is a schematic block diagram of the process cartridge shown in FIG. 19 installed in the image forming apparatus.
Figure 18:
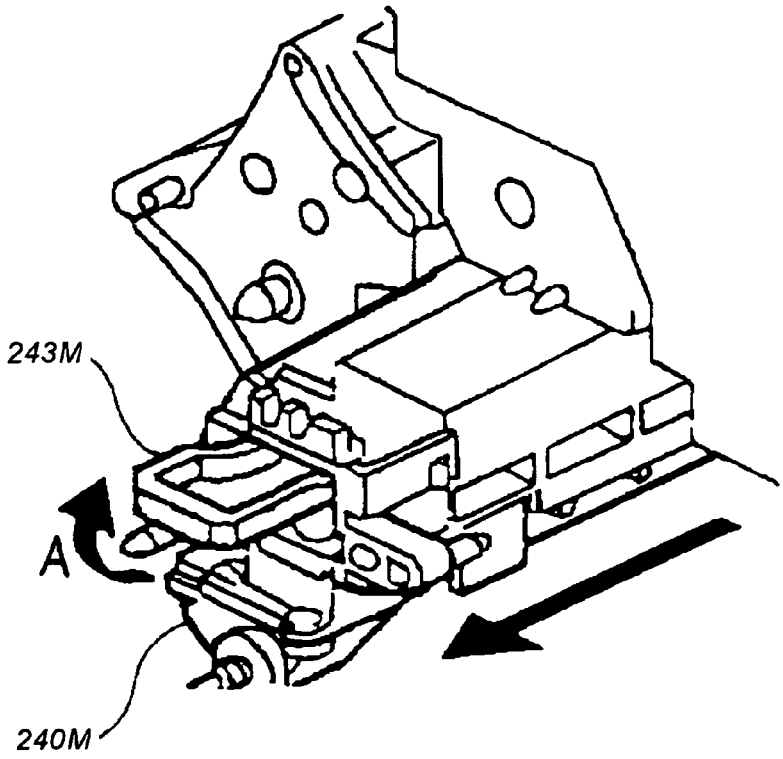
FIG. 18 illustrates a state in which the magenta process cartridge shown in FIG. 19 is pulled out from a station.

In the image forming apparatus body as shown in FIG. 16, process cartridges 240Y, 240M, 240C, and 240Bk for yellow, magenta, cyan, and black are respectively inserted into the stations 208Y, 208M, 208C, and 208Bk. Station color display sections 207Y, 207M, 207C, and 207Bk corresponding to the respective toner colors are respectively provided near the opening of the stations 208Y, 208M, 208C, and 208Bk. As shown in FIG. 17, reflective type photo sensors 209Y, 209M, 209C, and 209Bk, and antennas 210Y, 210M, 210C, and 210Bk for receiving the information from the IC tag attached to the process cartridge are respectively provided on the other side of the respective stations 208Y, 208M, 208C, and 208Bk. FIG. 18 illustrates a state in which the magenta process cartridge is pulled out from the magenta station 208M. Because the configuration for yellow, cyan, and black is the same, explanation thereof is omitted. A pull-out lever 243 is provided on the front side of the process cartridge 240M. When the process cartridge is fitted inside the apparatus body, the pull-out lever 243 is bent upward as shown by arrow A. When the process cartridge 240M is pulled out from the apparatus body, the lever 243 is brought down, so that the process cartridge 240M can be easily pulled out.

Figure 19:
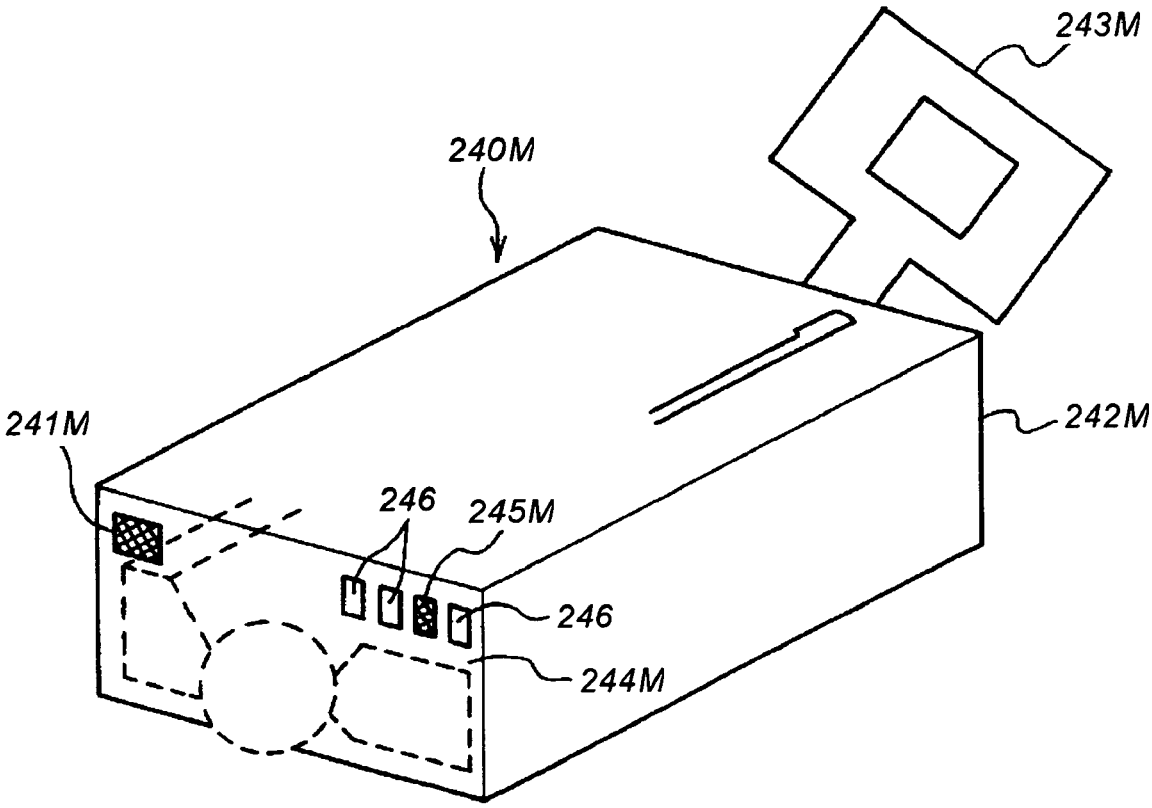
FIG. 19 is a block diagram of a process cartridge that includes a detector.

When life of the process cartridge ends, and the process cartridge is to be replaced, a process cartridge for replacement corresponding to the respective colors yellow, magenta, cyan, and black has been used conventionally. Therefore, a load is imposed on user management and storage, and production control in the factory. In this embodiment, therefore, the shape of the process cartridge is made the same to render the process cartridge common to all colors, and the color of the process cartridge is determined by the user, or at the time of factory shipment. Further, with identical shape of the process cartridge for the respective colors, the user may install a wrong process cartridge, and hence, a toner of a mismatching color may be mixed in the developing device. Therefore, in this embodiment, a unit is provided, which suspends the image forming operation of the apparatus when the user makes a mistake in installing the process cartridge, so that a toner of a mismatching color is not mixed in the developing device. The specific configuration is shown in FIG. 19. FIG. 19 is a block diagram of a magenta process cartridge, but the configuration is the same for other colors, yellow, cyan, and black. The magenta process cartridge 240M includes at least a developing device and an image forming processing unit. Sections to be detected for yellow, magenta, cyan, and black are provided on the other side 244M of the process cartridge. Reflectors 245Y, 245M, 245C, and 245Bk (collectively referred to as "a reflector 245") for yellow, magenta, and cyan black are respectively provided in the sections to be detected for yellow, magenta, cyan, and black, and a semitransparent seal 246 as a detachable member is respectively attached to these reflectors 245Y, 245M, 245C, and 245Bk. Further, an IC tag 241M is provided on the other side 244M of the process cartridge. As described above, a nonvolatile memory is installed in the IC tag 241M, so that the information of the process cartridge can be transferred to the image forming apparatus. The pull-out lever 243M is provided on the side 242M of the process cartridge.

The method of replacing the process cartridge will be explained next. For example, when life of the magenta process cartridge 240M ends, the user opens the door of the apparatus body, to pull out the process cartridge to be replaced from the station 208M. At this time, as shown in FIG. 16, the user confirms the color to be replaced from the station color display section 207M provided near the opening of the station 208M. The user then peels the seal 246 located in the magenta reflector 245M, from among the semitransparent seals attached to the other side of the process cartridge to be replaced shown in FIG. 19, to expose the magenta reflector 245M. The user then inserts this process cartridge into the station 208M in the apparatus body. At this time, the user confirms that the reflector's color is magenta by viewing the station color display section 207M for the magenta, provided near the opening of the station 208M. If the reflector exposed by peeling the seal is not the magenta, the user takes out the process cartridge from the station, sticks the peeled seal to the original position, peels the seal located at the reflector of the same color as that shown in the station color display section 207, and inserts the process cartridge into the station 208M once again. After inserting the process cartridge 240M into the station 208M, the user closes the door of the apparatus body, rendering the process cartridge the state as shown in FIG. 17. As shown in FIG. 17, when the process cartridge 240M is installed in the station 208M, the magenta reflective photo sensor 209M attached to the other side of the magenta station 208M faces the reflector 245M. The light from the LED is then reflected by the reflector 245M, and a lot of light is detected by the magenta photo sensor 209M. Thus, it is detected that the magenta process cartridge 240M has been fitted in the magenta station 208M. If the process cartridge is installed in the apparatus without peeling the seal, or the process cartridge is installed in the apparatus by peeling a tape at a wrong position, the part facing the sensor is covered with the seal, and the reflector is not exposed. Hence, the light from the LED is hardly reflected. Consequently, the photo sensor hardly detects the light. Thus, it is determined that a process cartridge of a correct color has not been installed in the apparatus body, and the user is informed of this matter by the alarm display.

Because the circuit of the color detector of the respective process cartridges is the same as that shown in FIG. 8, FIG. 8 and the explanation thereof are referred below. If a difference between the A/D converter input voltage and the pre-stored voltage value is more than twice, it shows that the seal 246 is peeled at two or more positions, and hence, a display is provided for confirmation. If the seal 246 is not peeled, the light incident onto the Htr becomes about half due to the semitransparent tape, and hence, a voltage value half the pre-stored voltage value is detected. In this case, an alarm is displayed to peel a tape corresponding to the color of the station in which the process cartridge is installed. Further, if the process cartridge has not been correctly installed in the apparatus body, the light incident to the Htr decreases, and a voltage value lower than the pre-stored voltage value is detected. In this case, an alarm indicating that the process cartridge has not been correctly installed is displayed.

In the process cartridge shown in FIG. 19, the semitransparent seal 246 is respectively attached to the reflectors 245Y, 245M, 245C, and 245Bk, but the process cartridge is not limited thereto. For example, the reflector 245 may be a mirror body, and the cyan, yellow, magenta, and black seals 246 may be attached to the respective reflectors, so that the user can recognize the color. In this case, the seal for the color to be replaced is peeled, to expose the reflector. When the user inserts the process cartridge into the station 208, the user compares the peeled seal with the station color display section 207 provided near the opening of the station 208, to confirm that the process cartridge is inserted in the station for the same color. Further, because the reflector is a mirror body, the amount of reflected light from the LED increases, thereby enabling reliable detection.

The IC tag 241M attached to the magenta process cartridge performs contact-less communication with the apparatus body. Because the block diagram of the IC tag attached to the magenta process cartridge is the same as that shown in FIG. 9, FIG. 9 and explanation thereof are referred to below. The IC tags attached to cyan, magenta, and black have the same configuration. Because the block diagram showing a part of the electric circuit of the image forming apparatus is the same as that shown in FIG. 10, and hence, FIG. 10 and the explanation thereof are referred to. Because the flowchart for color detection confirmation control in the process cartridge is the same as that shown in FIG. 11, FIG. 11 and the explanation thereof are referred to. The color detection confirmation control may be performed according to a flowchart shown in FIG. 12, other than the flowchart shown in FIG. 11, but the color detection confirmation control is the same as that shown in FIG. 12, and hence, FIG. 12 and the explanation for FIG. 12 are referred to.

Figure 20A:
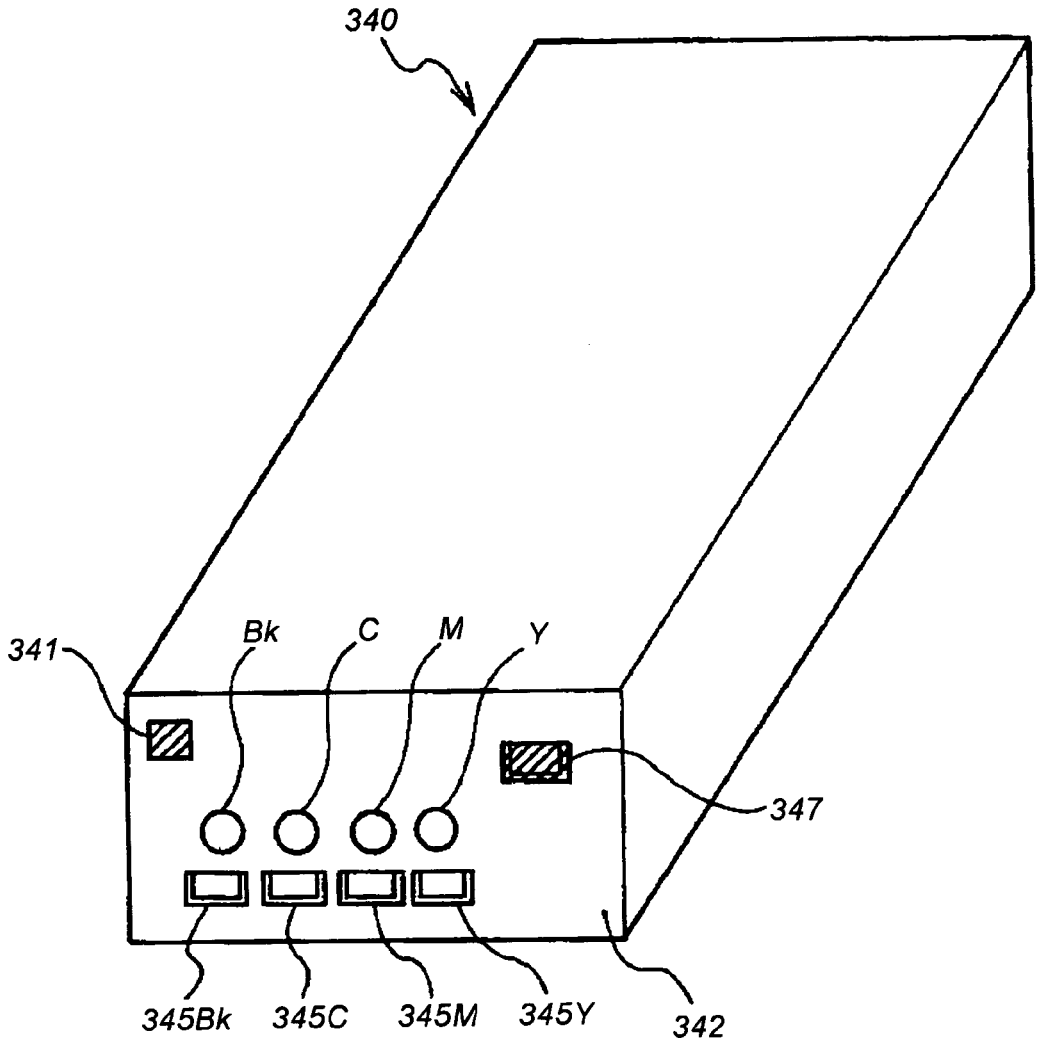
FIG. 20A is a perspective view and FIG. 20B is a side view of a process cartridge that includes another detector.
Figure 20B:
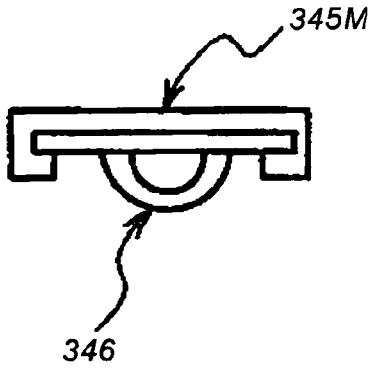

In the above explanation, the process cartridge shown in FIG. 19 has been explained as an example, but the process cartridge is not limited thereto. For example, as shown in FIG. 20B, the detachable member may be a conductive member 346, and is a section to be detected by the sensor. As shown in FIG. 20A, yellow, magenta, and cyan black are respectively displayed on a side 342 of the process cartridge 340. Fitting sections 345Y, 345M, 345C, and 345Bk in which the conductive member 346 is fitted are respectively provided below the respective colors. A lead for connecting the conductive member 346 to the GND is provided at a position in contact with the conductive member in the fitting section. During factory shipment of the process cartridge to be replaced for each color, the conductive member 346 is fitted to a fitting section 345M located below the display color of the same color as that of the toner (for example, magenta) included in the developing device (FIG. 20B). The conductive member 346 is then fixed in the fitting section by a fixing member, so that the conductive member 346 is not detached or moved by the user needlessly. On the other hand, when the toner is not contained in the developing device in the process cartridge so as to make the process cartridge for replacement common to the respective colors at the time of factory shipment, a storage unit 347 for storing the conductive member 346 is provided at the time of factory shipment, other than the fitting section 345. When the process cartridge having done its term of service is replaced by this process cartridge, the user takes out the conductive member 346 stored in the storage unit 347, and as shown in FIG. 20B, and fits the conductive member 346 to the fitting section 345M for the same color as that (for example, magenta) of the process cartridge to be replaced, thereby rendering the process cartridge the same color as that of the process cartridge to be replaced.

A method of replacing the process cartridge having done its term of service, for example, a magenta process cartridge 340M, by a process cartridge for replacement corresponding to the respective colors will be explained below. At first, the user opens the door of the image forming apparatus, to detach the magenta process cartridge 340M from the station 208M, and as shown in FIG. 20B, inserts the magenta process cartridge 340M for replacement in which the conductive member 346 has been fitted to the fitting section 345M. At this time, the user confirms that the color 207M displayed near the opening of the station 208M and the color located above the fitting section 345M to which the conductive member 346 has been fitted are the same magenta.

If the user notices that the colors are mismatching, the user fits the conductive member 346 to the fitting section 345M located below the same color as that of the color 207M displayed near the opening of the station 208M, and reinserts the process cartridge. Alternatively, the user replaces the process cartridge by a process cartridge in which the conductive member 346 is fitted to the fitting section 345M located below the same color as that of the color 207M displayed near the opening of the station 208M, and reinserts the magenta process cartridge. After inserting the process cartridge, the user closes the door of the apparatus body.

Figure 21A:
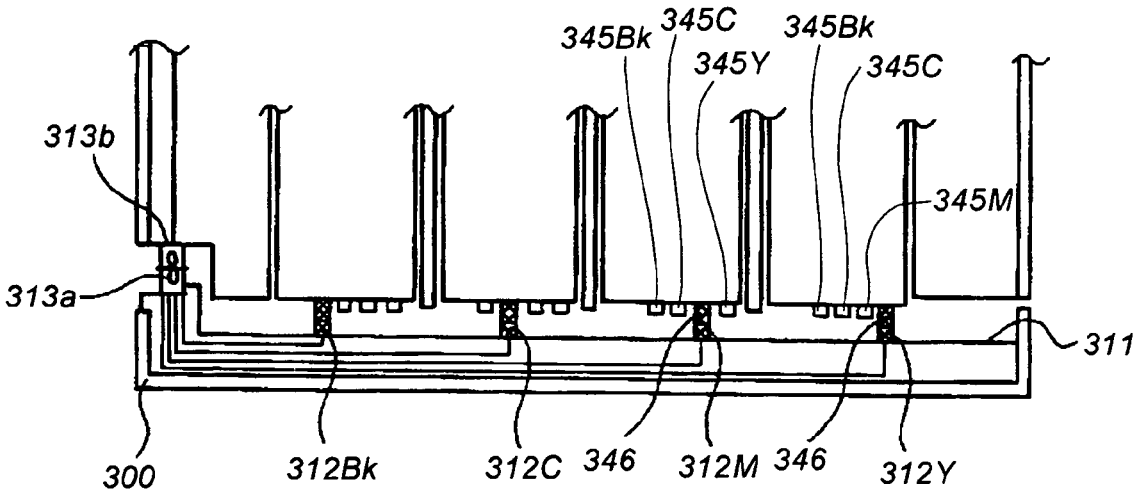
FIGS. 21A and 21B illustrate a door of the image forming apparatus body that includes the detector shown in FIG. 20B.
Figure 21B:
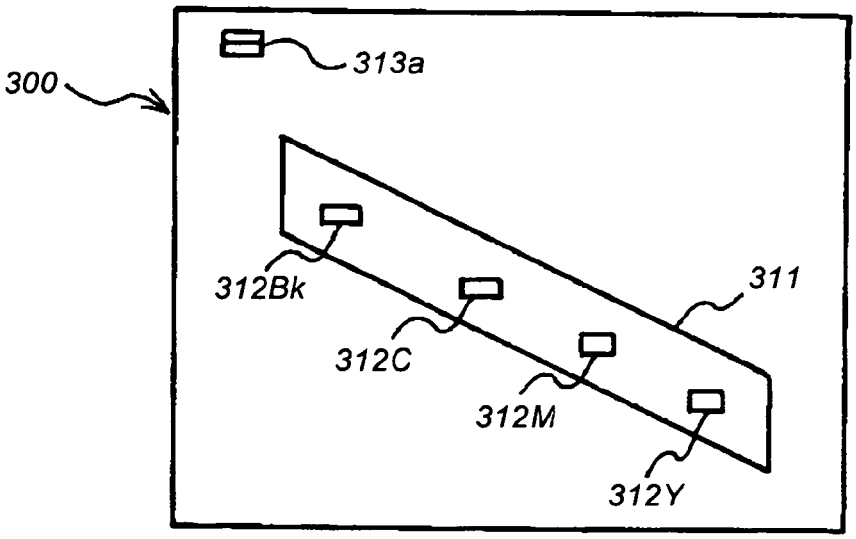

As shown in FIG. 21B, a stationary plate 311 is fitted to the door 300 of the apparatus body, and the connecting sections 312Y, 312M, 312C, and 312Bk are provided on the stationary plate 311 as a detector. As shown in FIG. 21A, these connecting sections are respectively provided at a position opposite to the opening of the respective stations 208Y, 208M, 208C, and 208Bk. These connecting sections are connected to a connector 313*a*, and the connector 313*a* is connected to a connector 313*b* formed in the apparatus body in the state with the door closed. When the process cartridge is installed correctly, as shown in FIG. 21A, these connecting sections 312Y, 312M, 312C, and 312Bk and the conductive member 346 fitted to the fitting sections in the respective process cartridges respectively come in contact with each other, in the state that the door of the apparatus body is closed. For example, if a process cartridge of a mismatching color is inserted such that the yellow process cartridge is installed in the magenta station, the conductive member 346 and the connecting section 312M do not come in contact with each other. Accordingly, it can be detected that the process cartridge of a mismatching color has been inserted. When a process cartridge of a mismatching color is installed, this matter is informed to the user by an alarm display, and the image forming operation is suspended. If such an alarm is displayed, the user opens the door of the apparatus body, and confirms the color 207 displayed near the opening of the station and the position of the conductive member 346 fitted to the fitting section on the side 342 of the process cartridge, in the state with the process cartridge installed, to replace the process cartridge by a process cartridge of the correct color, or change the position of the conductive member 346 to a position in the correct fitting section.

Figure 22:
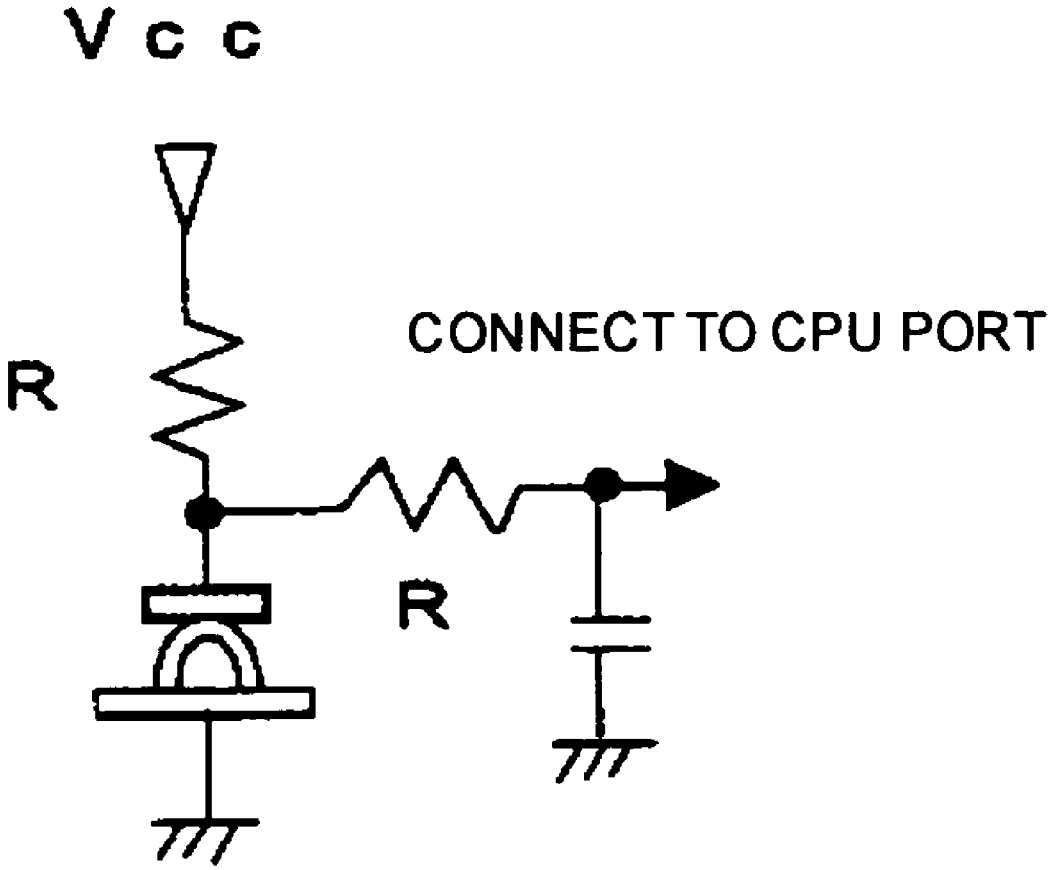
FIG. 22 illustrates a detection circuit of the process cartridge that includes the detector shown in FIG. 20B.

FIG. 22 is a circuit diagram of the color detector of the process cartridge shown in FIG. 20A. When the process cartridge is installed correctly in the right station, as shown in FIG. 21A, the connecting section 312 and the conductive member 346 come in contact with each other. The conductive member 346 comes in contact with a lead provided in the fitting section 345, and is connected to the GND. The electric current flowing from the voltage source located on the upstream side of the connecting section 312 is removed to the GND via the conductive member 346, so that the current does not flow to the CPU port. Accordingly, the voltage value of the CPU port becomes zero, thereby detecting that the process cartridge is correctly installed. On the other hand, when a process cartridge of a mismatching color is installed in the station 208, the conductive member 346 and the connecting section 312 are not connected to each other, and hence, a Vcc voltage is applied to the CPU port, thereby detecting that a process cartridge of a mismatching color is installed in the station.

An IC tag 341 is also provided in the process cartridge shown in FIG. 20A. Communication is then performed with the apparatus body, to compare the color stored in the apparatus body with the color stored in the memory in the IC tag. When the colors are mismatching with each other, an alarm is displayed to suspend the image forming operation. If there is no record of color in the memory in the IC tag, the color is recorded in the memory in the IC tag.

The color of the process cartridge may be detected by using a transmission type sensor. In a process cartridge 440 shown in FIG. 23A, as in the process cartridge 340 shown in FIG. 20A, yellow, magenta, cyan, and black are respectively displayed on a side 442 of the process cartridge 440, and fitting sections 445Y, 445M, 445C, and 445Bk are provided below the respective color displays. In these fitting sections, a shielding member 446 is fitted as a member to be detected. When the process cartridge is rendered a process cartridge for replacement for each color at the time of factory shipment, the shielding member 446 is fitted to the fitting section located below the display color the same as that of the toner contained in the developing device. The shielding member 446 is fixed to the fitting section by a fixing means so that the shielding member is not detached or moved by the user needlessly. On the other hand, when the toner is not contained in the developing device in the process cartridge so as to make the process cartridge for replacement common to the respective colors at the time of factory shipment, a storage unit 447 for storing the shielding member 446 is provided at the time of factory shipment, other than the fitting section. When life of the process cartridge ends and the process cartridge is replaced by this process cartridge, the user takes out the shielding member 446 stored in the storage unit 447, fits the shielding member 446 to the fitting section 445M for the same color as that of the process cartridge to be replaced, thereby rendering the process cartridge the same color as that of the process cartridge to be replaced.

In this manner, as in the process cartridge 340 shown in FIG. 20A, by seeing the side of the process cartridge, the user can recognize to which color of yellow, magenta, and cyan black the process cartridge corresponds. Further, as in the process cartridge 340 shown in FIG. 20A, by providing the color display section 207 near the opening of the station 208, the user can recognize that the process cartridge is installed in the correct position, by seeing the side 442 of the process cartridge and the display section 207 at the time of replacing the process cartridge.

Similar to that the structure shown in FIG. 21B, the stationary plate 311 is fitted to the door of the apparatus body, and transmission type sensors 412Y, 412M, 412C, and 412Bk as a detector are fitted to the stationary plate 311, instead of the connecting sections 312Y, 312M, 312C, and 312Bk. These transmission type sensors are respectively provided with an LED 412*a* as a light emission element and a phototransistor 412*b* as a photo-detector. These transmission type sensors 412Y, 412M, 412C, and 412Bk are respectively fitted at a position facing the openings of the respective stations 208Y, 208M, 208C, and 208Bk. These transmission type sensors are connected to the connector 313*a* as in FIG. 21, and the connector 313*a* is connected to the connector 313*b* formed in the apparatus body in the state with the door closed. When the process cartridge is installed correctly, as shown in FIG. 23B, the shielding member 446 blocks out the light emitted from the LED 412*a* of the transmission type sensor so that the light does not reach the phototransistor 412*b*, in the state with the door closed. On the other hand, if a wrong process cartridge is installed, the light emitted from the LED 412*a* of the transmission type sensor is not blocked out by the shielding member 446, and is received by the phototransistor 412*b*.

Figure 23A:
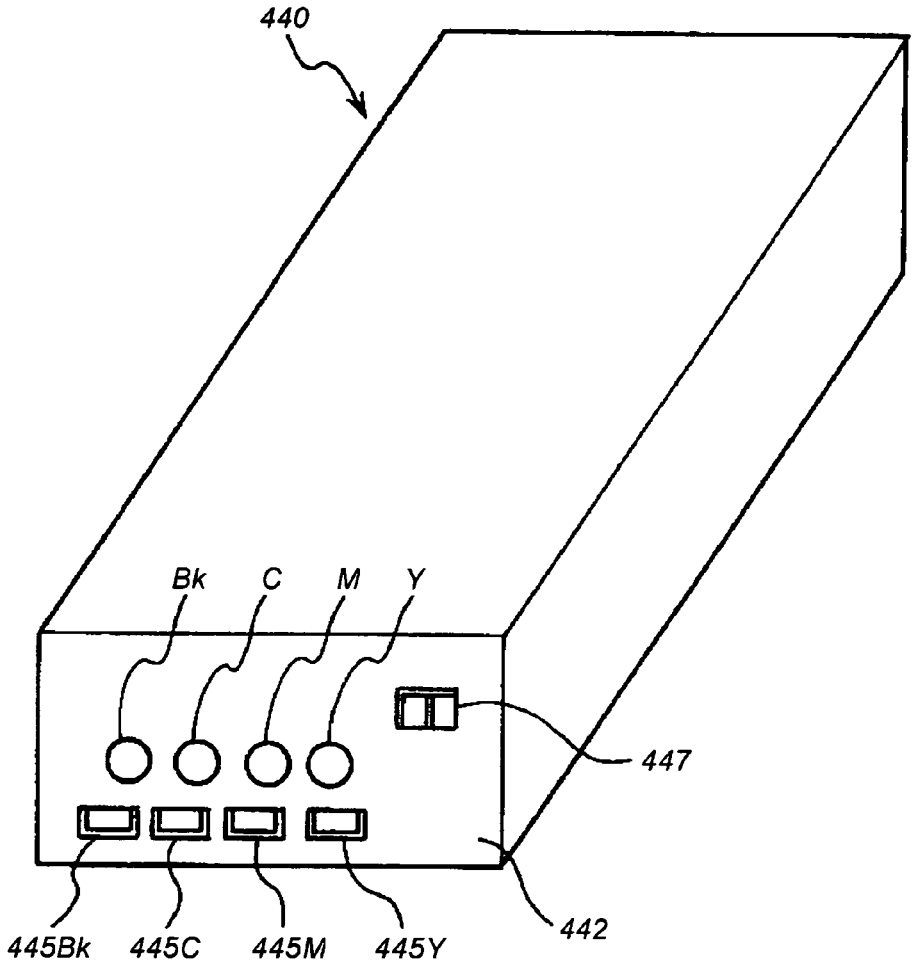
FIG. 23A is a perspective view and FIG. 23B is a side view of a process cartridge that includes still another detector.
Figure 23B:
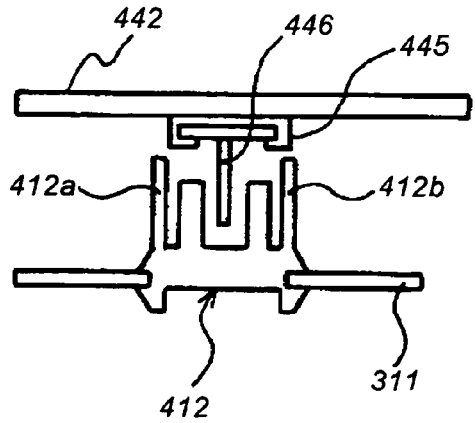
Figure 24:
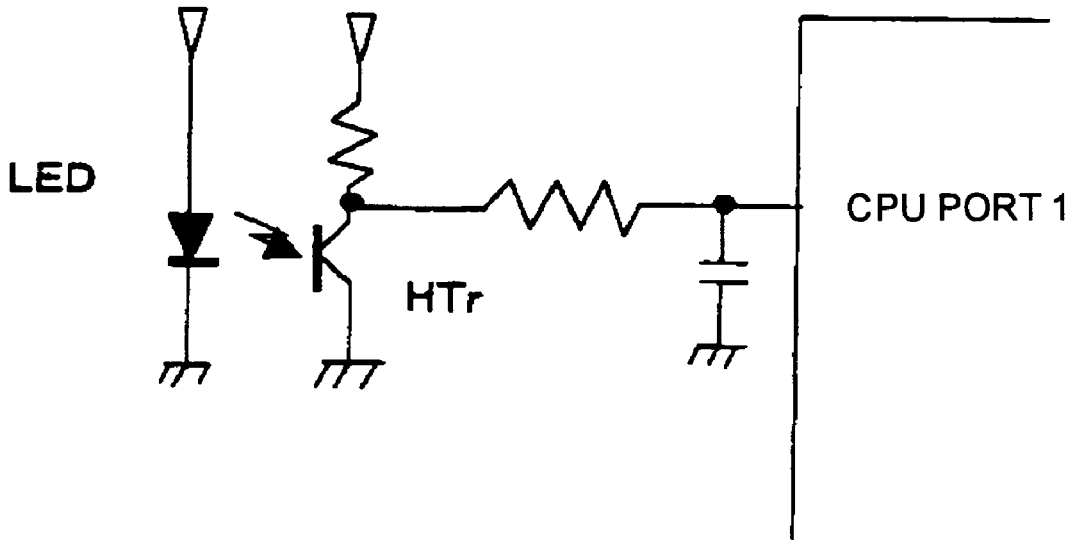
FIG. 24 is a circuit diagram of the process cartridge that includes the detector shown in FIG. 23B.

FIG. 24 is a circuit diagram of the color detector of the process cartridge 440 shown in FIG. 23A. The Htr is connected to the power source with one terminal, and connected to the GND with the other terminal. When the process cartridge is correctly installed, the shielding member blocks out the light from the LED, so that the light does not enter into the Htr, and hence the circuit between the power source and the GND is closed. Therefore, the Vcc voltage is applied to the CPU port. By detecting this voltage, the CPU port detects that the process cartridge is correctly installed. On the other hand, if the process cartridge is not correctly installed, the light from the LED enters into the Htr, rendering the circuit between the power source and the GND open. Accordingly, the electric current flowing from the power source flows from the Htr to the GND, thereby rendering zero voltage of the CPU port. The CPU port detects this voltage value, and detects that the process cartridge is not installed correctly.

An IC tag (not shown) can be provided in the process cartridge 440 shown in FIG. 23A. Communication is performed with the apparatus body, to compare the color stored in the apparatus body with the color stored in the memory in the IC tag, as in the flowchart shown in FIG. 11. In case of mismatching colors, an alarm is displayed to suspend the image forming operation. When there is no record of color in the memory in the IC tag, the color is recorded in the memory in the IC tag.

Figure 25A:
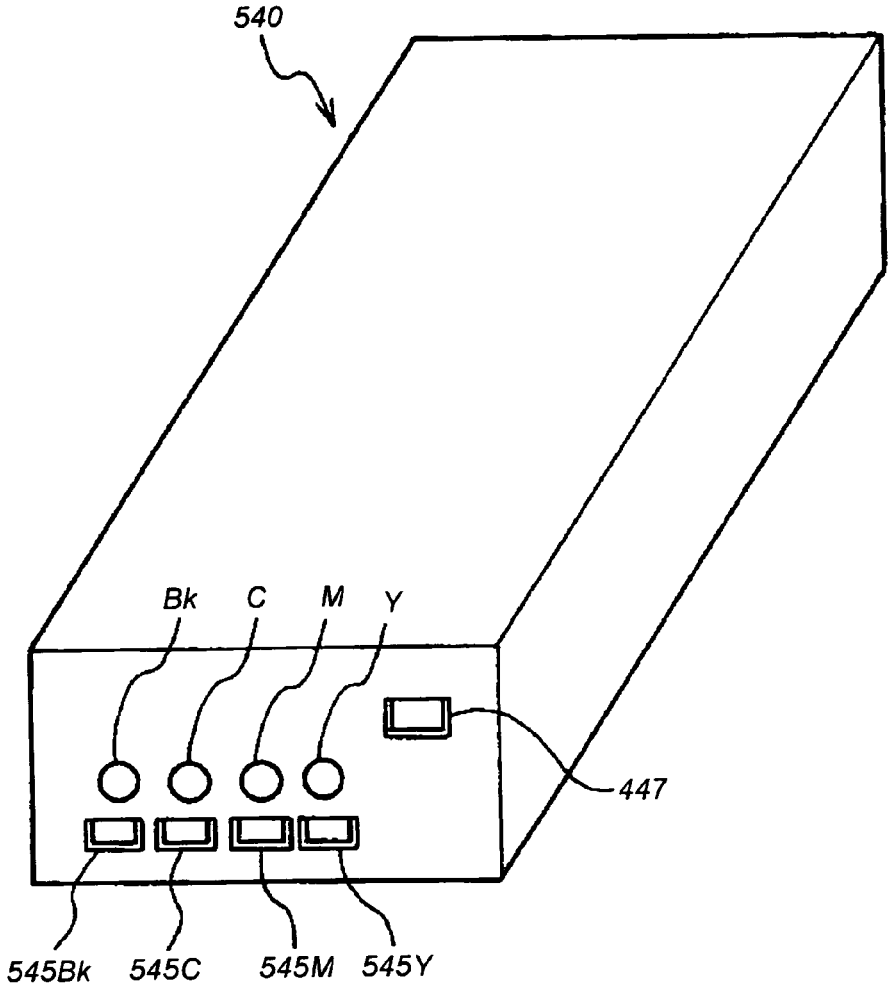
FIG. 25A is a perspective view and FIG. 25B is a side view of a process cartridge that includes still another detector.
Figure 25B:
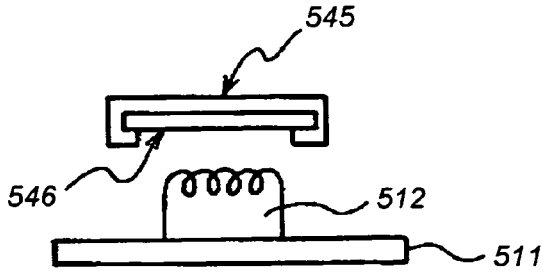

As shown in FIG. 25B, an IC tag 546 may be used as a detachable member of a process cartridge 540. The process cartridge 540 has the same configuration as that of the process cartridges 340 and 440 shown in FIGS. 20A and 23A respectively. As shown in FIG. 25B, the IC tag 546 is fitted to a fitting section of a predetermined color, to which the IC tag 546 is to be installed, that is, one of 545Y, 545M, 545C, and 545Bk, to make the process cartridge for the predetermined color. By fitting the IC tag 546 in the fitting section for the predetermined color, the user can recognize the color corresponding to the process cartridge. Accordingly, as in the above embodiment, the user can recognize whether the process cartridge is installed in the correct position by comparing the IC tag with the color display 207 near the opening of the station.

Figure 26:
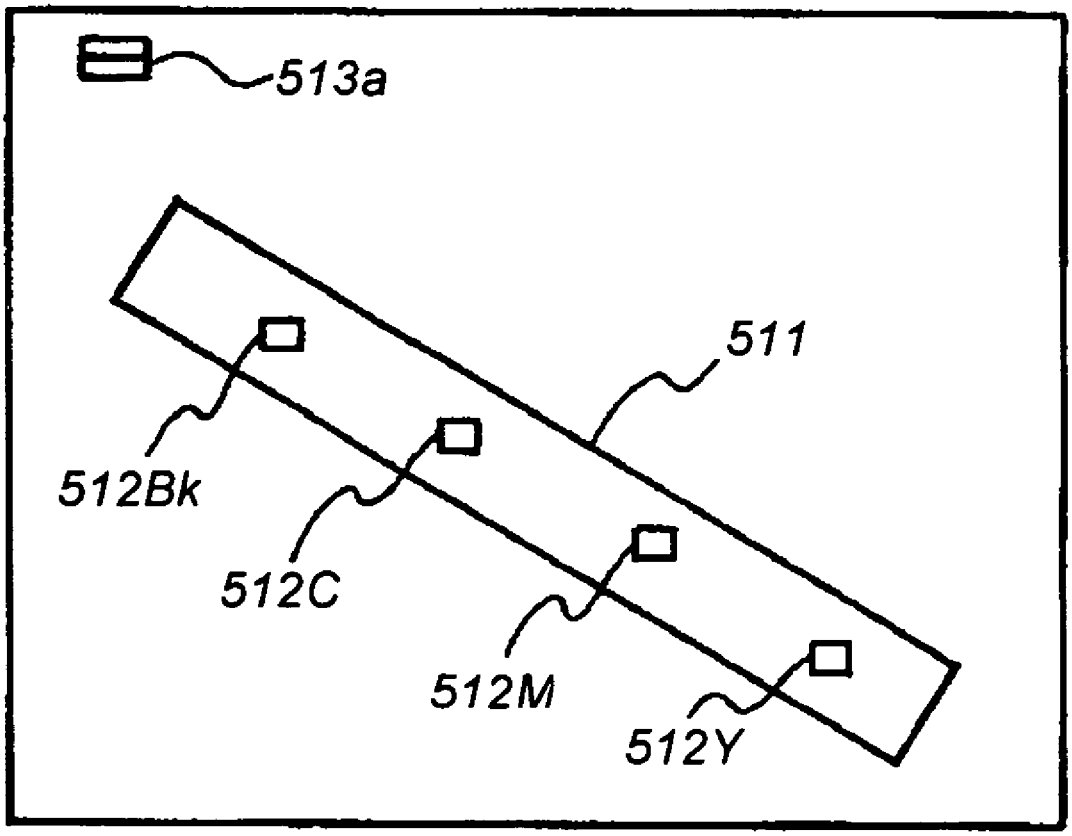
FIG. 26 is a schematic block diagram of a door of the image forming apparatus that includes the detector shown in FIG. 25B.

As shown in FIG. 26, a stationary plate 511 is fitted to the door 300 of the apparatus body, and antennas 512Y, 512M, 512C, and 512Bk are provided on the stationary plate 511 as detectors. These antennas 512Y, 512M, 512C, and 512Bk are respectively provided at a position opposite to the opening of the respective stations 208Y, 208M, 208C, and 208Bk. These antennas 512Y, 512M, 512C, and 512Bk are connected to the connector 313*a* and the connector 313*a* is connected to an I/O control board 713 in the apparatus body, and also connected to a connector 513*b* (not shown) on the apparatus body side, formed in the apparatus body, in the state with the door closed. When the process cartridge is installed correctly, as shown in FIG. 25B, the IC tag 546 and the antenna 512 face each other so that communication with the apparatus body becomes possible, in the state that the door of the apparatus body is closed. On the other hand, if the process cartridge is installed in a wrong position, the IC tag 546 does not face the antenna 512, and communication with the apparatus body is not possible.

Figure 27A:
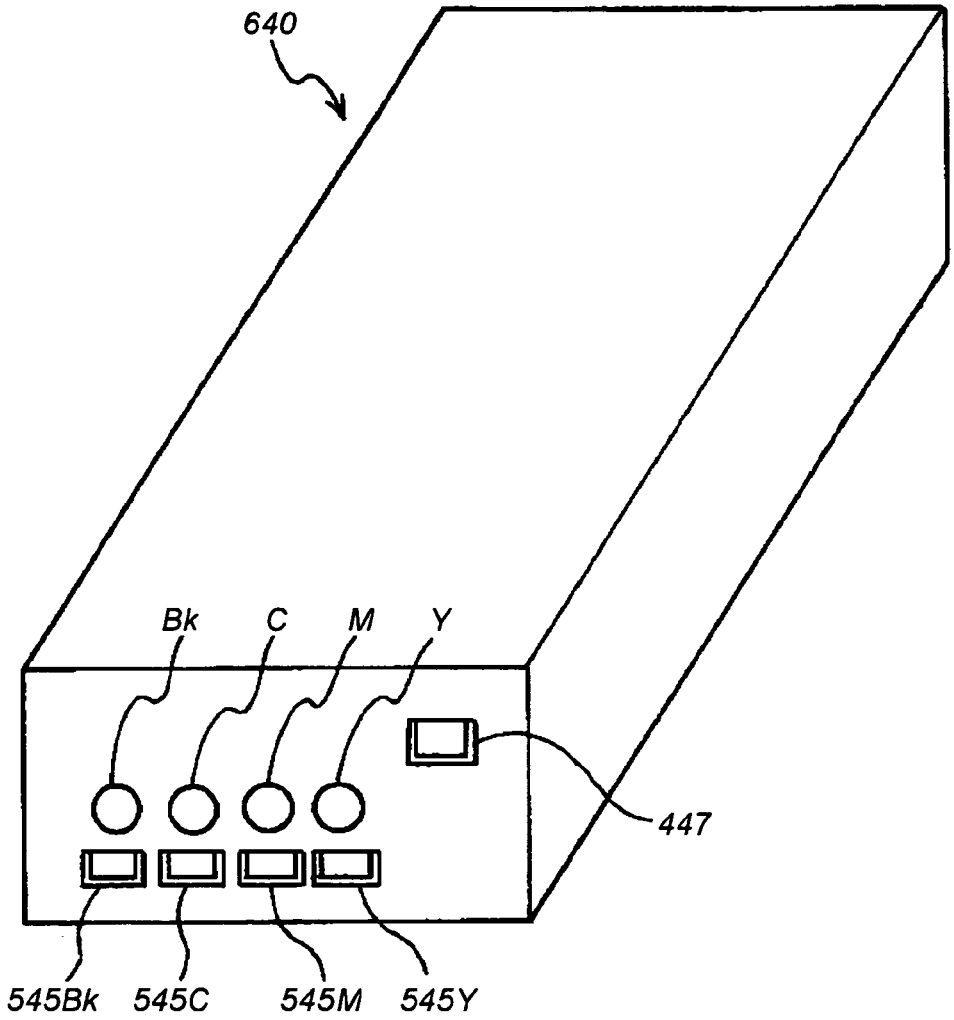
FIG. 27A is a perspective view and FIG. 27B is a side view of a process cartridge that includes still another detector.
Figure 27B:
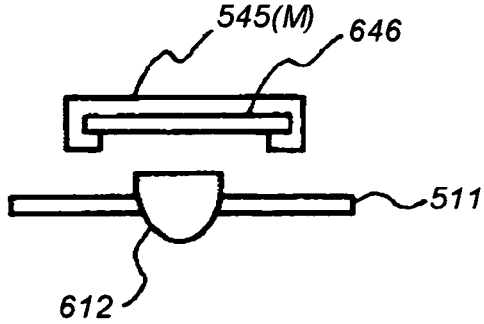

As in a process cartridge 640 shown in FIGS. 27A and 27B, the detachable member may be a reflector 646, and the detecting member may be a reflective photo sensor 612. Further, in this embodiment, a process cartridge including the developing device and the image forming processing unit has been explained, but the present invention is not limited thereto. As shown in FIG. 3, the present invention is also applicable to a developing device or a toner cartridge detachable from the image forming apparatus, and a development unit including the developing device and the toner cartridge.

According to the image forming apparatus in this embodiment, by peeling one of the four seals of the yellow, magenta, and cyan black, that are detachable members, the process cartridge corresponding to the respective colors can be obtained. Accordingly, the parts of the process cartridge can be common to all colors, thereby reducing the production cost. Further, because the position of the seal for each color is different, the user can confirm to which color this process cartridge corresponds, only by confirming the position where the seal has been peeled. This process cartridge is then installed in the station, and the reflective sensor in the respective stations detect the presence of the seal at a position corresponding to the respective toner color. When the reflective sensor detects that there is no seal, it is detected that a process cartridge for the same color as that of the station has been installed. In contrast, when the reflective sensor detects a seal, a process cartridge for a mismatching color has been installed, thereby detecting error in installation. In the conventional method of preventing installation errors, the shape of the station and the process cartridge are different for each color so that a process cartridge for a mismatching color is hot installed in the station. In such a case, if a user tries to install a process cartridge forcibly in the station without noticing that the color is mismatching, the apparatus or the process cartridge may be damaged. In this embodiment, however, after the process cartridge is installed in the station, it is detected whether the process cartridge for the correct color has been installed. Consequently, even if there is an installation error, the apparatus and the process cartridge are not damaged.

Furthermore, the storage unit for storing the reflector as the detachable member is provided. Therefore, when replacing the process cartridge, the process cartridge stored by the user can be made the same shape as the process cartridge to be replaced. Accordingly, it is not necessary for the user to store the process cartridges for different colors separately, thereby reducing the load on the user. Further, the detachable member is a reflector, and the detector is a reflective optical sensor. The detachable member is fitted to one place of the fitting sections yellow, magenta, cyan, and black of the process cartridge, to make the process cartridge correspond to each color. Thus, the user can recognize the color of the process cartridge only by confirming the fitting position of the reflector, thereby avoiding installation errors. The process cartridge corresponding to each color is installed in the station, and the respective reflective sensor in the station detects the position where the reflector has been fitted. When the process cartridge corresponding to the same color as that of the station is installed, the reflective sensor detects the reflector, thereby detecting that the process cartridge has been correctly installed. When the reflector is not detected, an alarm indicating that a process cartridge for a mismatching color has been installed is displayed.

Further, the detachable member may be a shielding member, and the detector may be a transmission type sensor. In this case, if the shielding member blocks out the light to the transmission type sensor, it can be detected that the process cartridge has been installed in the station for the same color.

The detachable member may be an IC tag, and the detector may be an antenna. In this case, because the antenna communicates with the IC tag, it can be detected that the process cartridge has been installed in the station for the same color.

The detachable member may be a conductive member, and the detector may be a connecting section to be connected with the conductive member. In this case, because the conductive member and the connecting section are connected to each other, it can be detected that the process cartridge has been installed in the station for the same color.

Moreover, when the detector detects that the process cartridge is not installed in the correct position, the copying operation is suspended. Therefore, a situation where the user wrongly starts the copying operation, and the toner stored in the developing device is mixed with another color toner, is avoided.

Furthermore, the IC tag is attached to the process cartridge, and when communication is not established between the IC tag and the apparatus body, the image forming operation is suspended. Communication not established between the IC tag and the apparatus body indicates that the process cartridge has not been installed in the station, or not installed correctly. In such a state, if the image forming operation is started, a problem may occur in the apparatus. In this embodiment, however, because the image forming operation is suspended, no problem occurs in the apparatus. After the communication between the IC tag and the apparatus body is established, the voltage value detected by the detector is compared with the voltage value pre-stored in the apparatus body, to thereby detect the installation state of the process cartridge. Therefore, it can be detected whether the process cartridge is not installed in the station, or is installed in a wrong place, thereby enabling a precise alarm display.

Moreover, if the color ID is not found in the IC tag, the color ID is stored in the IC tag. Accordingly, when life of the process cartridge ends, and the process cartridge is recycled, it can be recognized which color toner was stored in the developing device, by reading the information stored in the IC tag.

Furthermore, the station color display section is provided near the station in the image forming apparatus. Therefore, when installing the process cartridge, the user can confirm that the process cartridge is installed in the correct station, thereby preventing installation errors.

Moreover, the reflective optical sensor detects the color of the reflector. Therefore, it can be detected that the process cartridge is installed at a position for the same color as that of the station, thereby preventing installation errors.

Furthermore, the voltage value detected by the detector is compared with the voltage value pre-stored in the apparatus body, to thereby detect the installation state of the process cartridge. Therefore, not only whether the process cartridge is installed at a position for the same color as that of the station, but also the installation state of the process cartridge can be detected. For example, when a difference between the voltage output from the detector and the voltage value pre-stored in the apparatus body is more than twice, it can be detected that the seal is peeled at two or more positions, and when a voltage value can be hardly detected, it can be detected that the process cartridge has not been installed in the station. Accordingly, a precise alarm can be displayed for the user.

Moreover, when the voltage detected by the detector is different from the voltage value pre-stored in the apparatus body, the image forming operation is suspended. Therefore, a situation where the user wrongly starts the copying operation, and the toner stored in the developing device is mixed with another color toner, can be avoided.

Furthermore, the seal as the detachable member is semi-transparent. Therefore, the reflector color is visible through the seal, and the user can recognize which color reflector is exposed by peeling which tape. Thus, an error in peeling the tape can be avoided.

Moreover, by fitting the detachable member in the fitting section, the developing device can be made common to all colors. Therefore, the developing device body and the detachable member can be made common members. Therefore, the production cost reduces. Further, after the developing device is installed in the installation section for the developing device in the image forming apparatus, the detector provided in the installation section for the developing device detects whether the detachable member in the installation section for the developing device corresponds to the same color as the toner color. By the presence of the detachable member, it can be detected whether the developing device storing the toner of the same color as that of the toner corresponding to the installation section for the developing device is installed. By this detection result, the image forming operation is suspended, or an alarm indicating that a mismatching developing device has been installed can be provided to the user. Accordingly, installation error of the developing device can be detected. Hence, a situation where the user forcibly installs the developing device, and the resulting damage in the apparatus can be avoided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of developing devices, each of the developing devices configured to store a toner, the developing devices including a color display section that displays different toner colors, at least one of the toner colors corresponding to a color of the toner in the respective developing device, wherein the different toner colors, except for the toner color that corresponds to the color of the toner in the respective developing device, are covered by shielding members that are detachably attached over the color display section;

a developing device installation section, configured to detachably install the plurality of developing devices;

a color display unit formed on the developing device installation section and configured to displays a predetermined toner color corresponding to a toner color of a developing device of the plurality of developing devices that is detachably installed in said developing device installation section; and a detector configured to detect whether the toner color of the color display section of the developing device that is not covered by the shielding members matches the predetermined toner color assigned to the developing device installation section, after the developing device is installed in the developing device installation section.

2. The image forming apparatus according to claim 1, wherein the predetermined toner color assigned to the developing device installation section is displayed on a section of the developing device installation section in a proximity of an insertion opening for the respective developing device.

3. The image forming apparatus according to claim 1, wherein the color display section shielding members are made of a translucent adhesive material.

4. The image forming apparatus according to claim 1, wherein the developing device installation section includes a detecting section facing the color display section to be detected of the developing device, the detecting section corresponding to the predetermined toner color assigned to the respective developing device installation section.

5. The image forming apparatus according to claim 4, wherein the color display section to be detected is a conductive member, and the detecting section is configured to detect whether the toner color corresponding to the toner stored in the developing device matches the predetermined toner color assigned to the respective developing device installation section, based on a connection state between the detecting section and the conductive member.

6. The image forming apparatus according to claim 4, wherein the shielding member for the color display section to be detected is a nonconductive member.

7. The image forming apparatus according to claim 4, wherein an auxiliary mark of a same color as the toner color stored in the developing device is provided near the shielding member.

8. The image forming apparatus according to claim 4, wherein the color display-section to be detected is painted in a color corresponding to the toner color stored in the respective developing device, and the detecting section is a reflective optical sensor that detects the color of the section to be detected.

9. The image forming apparatus according to claim 8, wherein an output value output by the reflective optical sensor is different depending on the color detected by the reflective optical sensor.

10. The image forming apparatus according to claim 9, further comprising:

a controller configured to compare the output value output by the reflective optical sensor with a pre-stored output value that is pre-stored in the image forming apparatus, and to suspend an image forming operation if the output value and the pre-stored output value differ.

11. The image forming apparatus according to claim 9, further comprising:

a reporting unit configured to report an alarm content if the output value is different from a pre-stored output value that is pre-stored in the image forming apparatus; and a controller configured to control the reporting unit to change the alarm content, based on a difference between the output value output by the reflective optical sensor and the pre-stored output value.

12. The image forming apparatus according to claim 1, wherein an auxiliary mark of a same color as the toner color stored in the developing device is provided near the color display section shielding member.

13. The image forming apparatus according to claim 4, wherein the shielding member for the section to be detected is translucent.

14. The image forming apparatus according to claim 1, wherein an IC tag is attached to the developing devices, and the IC tag includes a communication unit that configured to communicate with an image forming apparatus body, and a controller configured to suspend an image forming operation if communication between the IC tag and the image forming apparatus body is not established.

15. The image forming apparatus according to claim 14, wherein after the communication between the IC tag and the image forming apparatus body is established, an output value output from a reflective optical sensor, corresponding to a color detected by the reflective optical sensor is compared with a pre-stored output value that is pre-stored in the image forming apparatus.

16. The image forming apparatus according to claim 14, further comprising:

a writing unit configured to write a color ID in the IC tag, if the color ID is not already stored in the IC tag.

* * * * *